United States Patent [19]

Keritsis

[11] Patent Number: 4,506,684

[45] Date of Patent: Mar. 26, 1985

[54] MODIFIED CELLULOSIC SMOKING MATERIAL AND METHOD FOR ITS PREPARATION

[75] Inventor: Gus D. Keritsis, Richmond, Va.

[73] Assignee: Philip Morris Incorporated, New York, N.Y.

[21] Appl. No.: 189,891

[22] Filed: Sep. 22, 1980

Related U.S. Application Data

[62] Division of Ser. No. 930,328, Aug. 2, 1978, Pat. No. 4,333,484.

[51] Int. Cl.[3] ..... A24B 15/24; A24B 15/26; A24B 15/28

[52] U.S. Cl. ..... 131/369; 131/359; 131/352; 131/353; 131/370; 162/181.2; 162/183; 162/158

[58] Field of Search ..... 131/360, 370, 369, 352, 131/353, 358, 359; 162/181.2, 183, 158

[56] References Cited

U.S. PATENT DOCUMENTS

| | | | |
|---|---|---|---|
| 1,086,386 | 2/1914 | Menzies | 162/181.2 |
| 2,226,841 | 12/1940 | Barnhart | 162/181.2 |
| 3,529,602 | 9/1970 | Hind et al. | 131/360 |
| 3,613,693 | 10/1971 | Monte | 131/360 |
| 3,807,414 | 4/1972 | Hedge | 131/360 |
| 3,931,824 | 1/1976 | Miano et al. | 131/360 |
| 3,943,942 | 3/1976 | Anderson | 131/360 |
| 3,987,802 | 10/1976 | Austin | 131/360 |
| 4,008,723 | 2/1977 | Borthwich et al. | 131/360 |
| 4,109,664 | 8/1978 | Hedge | 131/360 |
| 4,233,993 | 11/1980 | Miano et al. | 131/360 |

*Primary Examiner*—V. Millin

[57] ABSTRACT

A process for producing a synthetic smoking material is disclosed. The process preferably comprises forming an aqueous slurry of cellulosic material, preferably in the form of loose and slightly beaten cellulose fibers, adding certain metal salts to the slurry, casting the same and thereafter drying, conditioning and slitting or cutting the resulting sheet to produce a low tar filler material. The water-soluble metal salts to be added are selected from the group consisting of calcium salts, magnesium salts, iron salts, and aluminum salts, and are preceded or followed by addition of ammonium or alkali metal salts capable of precipitating the cation of the said water-soluble salts.

25 Claims, No Drawings

MODIFIED CELLULOSIC SMOKING MATERIAL AND METHOD FOR ITS PREPARATION

This is a division of application Ser. No. 930,328, filed Aug. 2, 1978 now U.S. Pat. No. 4,333,484.

BACKGROUND OF PRIOR ART

Many attempts have been made to utilize cellulosic materials, such as alpha-cellulose, as smoking materials to be used as tobacco replacements or supplements. However, alpha-cellulose and similar materials, in untreated form, have not been found to be entirely satisfactory materials, either with regard to their burning characteristics or with regard to certain other properties. Attempts have been made to modify cellulose by oxidative techniques, by heat techniques and by the addition of various materials to modify the properties of the cellulose. Despite these many techniques, cellulose has not been found to be completely satisfactory as a smoking material.

Cellulose has been oxidized by treatment with nitrogen dioxide and similar materials. For example, U.S. Pat. No. 3,461,879 relates to tobacco substitutes in which the combustible portion is oxidized cellulose or is an oxidized material which contains a significant percentage of alpha-cellulose. The theory behind such treatments is believed to involve the oxidation of the primary hydroxyl groups of the cellulose molecule to form carboxyl groups in their place. The oxidation of the cellulose is said to have the effect of reducing the delivery or TPM (total particulate matter) from the cellulose and to also produce a more desirable taste in the smoke. However, such oxidation, for example with nitrogen dioxide, involves relatively high equipment investment and operating costs and does not produce an entirely satisfactory product.

In addition, various heat treatments have been tried, in attempts to improve the burning properties of cellulose. For example, U.S. Pat. Nos. 3,705,589 and 3,545,448 relate to heat-treated cellulosic materials for use in smoking products. However, the materials produced by such treatments have also not been found to be totally satisfactory.

Compositions which have included certain types of untreated cellulose in combination with other materials, for example as described in U.S. Pat. No. 3,807,414, have also not been found to provide all of the desired effects.

It is also well known in the art that smoking articles may be prepared from a variety of combustible or burnable materials and many materials have been suggested for substitutes or as additives for tobacco. However, such compositions have also not been found to be totally satisfactory.

Some of the teachings of the prior art are summarized hereinafter, with patents being presented in numerical order.

U.S. Pat. No. 1,334,752 relates to a fluid for treating tobacco leaves or like plants. The fluid is obtained by boiling resin in a solvent of NaCl and by boiling the same in a solvent of $NaHCO_3$ and a solution of organic salt of iron.

U.S. Pat. No. 1,680,860 related to a smokeable tobacco substitute and process using eucalyptus, adding glycerine or honey or molasses (as a hydroscopic agent to prevent drying out of the end product). $KNO_3$ is used in an aqueous solution to treat leaves to augment flagration of the end product so that it is made useable for cigarettes and for pipe smoking purposes. The leaves are air dried, crushed between rollers, macerated in $KNO_3$ solution for three hours, drained and put in a pressure vessel at 100°–200° F. for three hours. The leaves are then compressed and heated up to 212° F., then shredded as filler.

U.S. Pat. No. 2,576,021 teaches that it is known to use wood pulp to make a paper sheet and soak with tobacco extract to make a tobacco substitute and relates to an improvement using fibers of bagasse preferably sugar cane bagasse preferred over wood pulp, cotton linen, ramie, sisal and other similar fibers because it has a chemical composition similar to tobacco in respect to cellulose, gums, fats and waxes. The process involves washing the sheet and treating it with NaOH or other alkali, and forms a sheet using Fourdrinier equipment. Certain substances can be added to impart desired taste, aroma and color.

U.S. Pat. No. 2,907,686 relates to a tobacco substitute, an elongated cylinder made by charring a piece of wood, to produce charcoal. The wood is charred in the absence of air at 250°–800° C. (4–6 hours). The product may include carrier for flavoring agent: charcoal, Fuller's earth, natural or activated clays; aromatic flavoring agent: natural or synthetic oils, e.g. vanilla, eucalyptol, octyl acetate, isoamyl isovalerate. A smoke-forming agent, preferably an edible solid or liquid, e.g. glycerol, glycerol monoacetate, may be added. Coal tar colors may also be added. Ash-forming agent may be from a high ash source or may result from soaking a low ash source with a solution of ash-producing inorganic salts, e.g., $ZnCl_2$, $Ca(OH)_2$, KOH or $K_2CO_3$, MgO, $Al_2O_3$. Coating agents, e.g. sugar solutions or hard gum or resin may also be used.

U.S. Pat. No. 3,369,551 relates to a tobacco substitute base found by extracting plant leaves with water or an organic solvent with many additives listed. Dried materials are toasted to a golden brown color and treated with appropriate additives.

U.S. Pat. No. 3,461,879 relates to a tobacco substitute constituting oxidized cellulose in combination with a hydrated metal compound, for example magnesium citrate, hydrated alumina, calcium tartrate or magnesium sulfate. When hydrated metal compounds, for example magnesium sulfate or the other materials set forth in this patent are employed, the burning rate of the cellulose has been found to approach that of ordinary cured tobacco leaves and a more pleasant taste and aroma have been found to be produced in connection with the sidestream and mainstream of the tobacco smoke. Furthermore, the resulting ash has been found to be more satisfactory.

U.S. Pat. No. 3,545,448 relates to a smoking material comprising a carbohydrate material, such as cellulose, which is thermally degraded at 100°–250° C. until a weight loss of at least 10% has occurred, the degradation taking place in the presence of a strong mineral acid catalyst or in the presence of a salt of such strong acid with a weak base. The patent indicates that especially useful carbohydrate materials include alpha-cellulose, cellulose derivatives such as methyl cellulose, various polysaccharides and various gums.

U.S. Pat. No. 3,556,109 relates to a smoking material made from oxidized cellulose with various salts.

U.S. Pat. No. 3,556,110 relates to a smoking material made from oxidized cellulose with various salts.

U.S. Pat. No. 3,559,655 relates to a smoking material made from oxidized cellulose with various salts.

U.S. Pat. No. 3,612,063 relates to a smoking material made of oxidized cellulose combined with organic salts of potassium, lithium and copper, such as the oxalic, lactic, glycolic, diglycolic, pivalic or tannic acid salts, and with titanium dioxide.

U.S. Pat. No. 3,638,660 relates to a tobacco substitute material prepared from fibrous wood pulp containing at least 90% of alpha-cellulose which is lightly beaten to certain specifications and is then formed into a sheet having a density of 12–35 pounds per cubic foot. The beaten fibrous wood pulp is, during the formation of the sheet, combined with certain combustion modifiers, namely the sulfates of magnesium, sodium and potassium or the chlorides of potassium and magnesium or the carbonates and bicarbonates of sodium, potassium, magnesium and aluminum or potassium nitrate, ferric oxide, ferric hydroxide, alumina, the citrates and acetates of magnesium and glyconic acid. In the patent, it is stated that best results are obtained when cellulose is combined with hydrated magnesium sulfate and certain burning sustainers, namely potassium chloride, magnesium chloride, potassium sulfate, potassium nitrate and ferric oxide or hydroxide. Other burning sustainers are the potassium, sodium, magnesium and ammonium carbonates or bicarbonates. It is also stated that various flavors and humectants, as well as nicotine or other alkaloids, may be introduced into the sheet. It is further stated that ammonium compounds and various coloring agents may also be incorporated in the sheet. It is also stated that the presence of ammonia (for example in the form of ammonium sulfate or ammonium carbonate) is believed to inhibit the production of 3,4-benzpyrene.

U.S. Pat. No. 3,640,285 relates to a cigarette paper which is loaded with calcium oxalate or certain other alkaline earth metal salts of organic acids, which may be added as such or formed in situ in the paper.

U.S. Pat. No. 3,720,660 relates to oxidized cellulose and other polysaccharides, wherein the cellulose is reacted with such materials as strong acids, e.g. $H_2SO_4$, with nitrosyl chloride and the like.

U.S. Pat. No. 3,812,864 relates to a smoking material which is prepared by employing a combination of vinyl methyl ether:maleic anhydride copolymers with certain particulate inorganic materials (for example, calcium carbonates) and with a secondary combustible material which may be tobacco dust, cellulose, pectins, natural gums or the like.

U.S. Pat. No. 3,874,390 relates to a smokable product formed by heating cellulose to 150°–300° C. to obtain a degree of degradation of 5–30% by weight and combining the resulting degraded or carbonized cellulose with an inorganic filler which may be a hydroxide, an oxide or a hydrated oxide of aluminum, iron or silicon, to form a slurry which may then be cast into a sheet for ultimate use as a smoking material.

U.S. Pat. No. 3,924,642 discloses a smokable product having a cellulose based combustible material containing a chelate compound incorporated in an amount from 0.5 to 70% by weight of combustible material. The product may also contain fillers, compounds which split off ammonia, oxidizing agents, ammonium salts of polymeric acids, low sulfur content proteins and/or tobacco extracts.

U.S. Pat. No. 3,931,824 discloses a smoking product which incorporates carboxymethyl cellulose as a portion of its filler.

U.S. Pat. No. 3,965,911 discloses a tobacco substitute smoking material comprising an organic combustible material as a smoke-producing fuel, and protein. The organic combustible material may be a smoke-producing carbohydrate, such as alpha-cellulose, cellulose derivatives, sugars, starch, alginate, pectin, or natural gum.

German Offenlegungsschrift No. 2,262,829 discloses as a smokable product a cellulose sheet having added thereto a metal chelate of the type represented by magnesium aluminum citrate and magnesium iron citrate.

BRIEF SUMMARY OF INVENTION

Applicant has discovered a method for producing a synthetic smoking material which avoids substantially all of the above-noted disadvantages inherent in the prior art. Thus, the smoking material of the present invention incorporates and is based largely upon using cellulosic materials, which, in the prior art, have not met with great acceptability. In contrast to prior art processes, however, the present invention produces a smoking material which has flavor, aroma and burn characteristics similar to those of natural tobacco. Moreover, in addition thereto, the total particulate matter, such as tar and nicotine, and the puff count of typical cigarettes using this material as filler is also desirably reduced.

More particularly, this invention relates to an improved synthetic smoking material comprising a cellulosic material containing calcium, magnesium, iron, or aluminum salts. While the cellulosic material, such as, for example, alpha-cellulose, may be used in sheet or particulate form and the like, the process preferably comprises forming an aqueous slurry of the cellulosic material, desirably in the form of loose and slightly beaten cellulose fibers in water, then adding the above-mentioned salts to the slurry, casting the same and thereafter drying, conditioning and slitting the resulting sheet to produce a low tar filler material. A preferred embodiment of the invention resides in foaming the slurry prior to or in the course of casting the same to form an expanded product.

More particularly, in accordance with the present invention, from about 5 to 40% by weight and preferably from 10–30% by weight (based on the cellulose) of the calcium, magnesium, iron or aluminum water-soluble salts of certain organic or inorganic acids are added to the cellulosic material to produce a synthetic smoking product having burning characteristics and subjective character similar to natural leaf tobacco which makes the product highly desirable. These desired characteristics are further enhanced by the incorporation of various other additives which are more fully described hereinafter.

While the cellulose, either in sheet or particulate form, may simply be impregnated with the calcium, magnesium, iron or aluminum water-soluble salts of the organic and/or inorganic acids which are employed in accordance with this invention, their impregnation in the cellulose may also, if desired, be followed by: (1) adding an acid capable of producing a water-insoluble salt by reaction with the water-soluble salts, (2) treatment with ammonium and/or alkali metal salts of various acids capable of precipitating the calcium, magnesium, iron or aluminum metal or metals present in the water-soluble salts or (3) treatment with hydroxides, such as KOH, NaOH, LiOH or with $NH_4OH$.

Alternatively, the water-soluble metal salts may be added to the cellulose after the cellulose has been pretreated with any of the materials described and set forth in clauses (1) to (3) above.

DETAILED DESCRIPTION OF INVENTION

The present invention provides both an improved smoking material and a novel method for its preparation. Generally, the present invention comprises the incorporation of selected metal salts in cellulosic materials. While the cellulosic material, such as alpha-cellulose, may be in sheet or particulate form and the like, the process preferably comprises forming an aqueous slurry of the cellulosic material, preferably in the form of loose and slightly beaten cellulose fibers in water, then adding the salts to the slurry, casting the same and thereafter drying, conditioning and slitting or cutting the resulting sheet to produce a low tar filler material. A preferred embodiment of the invention, however, resides in foaming the slurry prior to casting the same to form an expanded product.

In particular, applicant has discovered that the use of from about 5 to 40% by weight and preferably from 10–30% by weight (based on the cellulose) of the calcium, magnesium, iron or aluminum water-soluble salts of certain organic or inorganic acids in a cellulosic synthetic smoking material imparts to such cellulosic material the burning characteristics and subjective character of natural leaf tobacco which makes the product highly desirable to be used alone or incorporated in other smoking products. These desired characteristics are even further enhanced where the above salts are used in combination with certain other materials, as discussed more fully hereinafter.

The cellulosic materials which may be employed in the present invention include alpha-cellulose materials which are composed mainly of alpha-cellulose and substituted cellulosic materials such as: carboxymethyl cellulose (CMC), cross-linked CMC or their salts (K, Na, $NH_4$, Ca, Mg); methyl cellulose, hydroxypropyl methyl cellulose, hydroxypropyl cellulose, ethyl cellulose, ethyl hydroxyethyl cellulose, hydroxyethyl cellulose, and the like, as well as pectin, alginic acid and their Na, K, $NH_4$, Ca, Mg salts, guar, modified guar gums or locust bean gum, gum arabic, xanthan, starch, modified starch, curdlan, salts of xanthomonas gum and other similar materials. Alpha-cellulose, being particularly preferred in the process of the present invention, improves the subjective character of smoke and the sheet/filler physical properties (strength and filling capacity), and provides process flexibility (product may be made either by casting, extrusion, papermaking processes or the like).

More particularly, the synthetic smoking materials of the present invention will contain one or more of the calcium, magnesium, iron or aluminum salts previously discussed and will most desirably include, in addition to cellulosic material, one or more of the following materials:

(1) Modified cellulose gums, such as carboxymethyl cellulose or cross-linked carboxymethyl cellulose and their Na, K, $NH_4$, Ca or Mg salts; methyl cellulose, hydroxypropyl methyl cellulose, hydroxypropyl cellulose, ethyl cellulose, ethyl hydroxyethyl cellulose, hydroxyethyl cellulose, oxy cellulose, and the like. These materials are desirably used because of their ease of availability, their purity and excellent binding properties, and their low sensitivity to the various polyvalent cations (Ca, Mg) which allows for better process control and physical sheet properties. Methyl and/or hydroxypropyl methyl cellulose or curdlan are particularly preferred due to their thermogelation characteristics which prevent the cracking of sheets as a result of shrinkage during the drying process. In addition, they are useful in "setting" the foamed structures and preventing them from collapsing during the drying of such sheets where a foaming agent is employed. One or more of these materials may be employed in an amount (the total amount if more than one are employed) of from 3 to 40% by weight (based on the total product). Of this group of materials, the following are particularly preferred components, particularly when used in the indicated amounts:

| | |
|---|---|
| Na, K, or $NH_4$ - CMC or cross-linked CMC | 4 to 40% |
| Hydroxypropyl, hydroxypropyl methyl, or methyl cellulose | 3 to 10% |
| Ethyl hydroxyethyl or hydroxyethyl or ethyl cellulose or oxy cellulose | 3 to 20% |
| Curdlan | 3 to 40% |
| | % based on total product |

(2) Salts of xanthomonas gum, particularly amine salts, for example, pectins, alginic acid and their Na, K, $NH_4$, Ca, Mg salts. One or more of these materials may be employed in an amount (the total amount if more than one are employed) of from 3 to 40% by weight (based on the total product). Of this group of materials, the following are preferred components, particularly when used in the indicated amounts:

| | |
|---|---|
| Salts of xanthomonas gum, pectin or Na, K, $NH_4$, Ca, or Mg pectate | 3 to 40% |
| Alginic acid or Na, K, $NH_4$, Ca, or Mg alginate | 3 to 40% |
| | % based on total product |

(3) Propylene glycol alginate is useful as a foam or emulsion stabilizer and strengthening agent and may be employed in an amount of from 3 to 10%, preferably 3 to 5%.

(4) Various gums, such as guar, xanthan gum, locust bean, starch, curdlan and their modified versions. These materials are desirable due to their availability and the acceptable character of smoke produced. In addition, being non-ionic, they are relatively insensitive to ions (viscosity-wise) thereby enabling good process control. Additionally, their binding capabilities make for good sheet formation and strength, especially for sheets that contain a substantial content of "filler" material, such as $CaCO_3$. In addition, the xanthan gum functions as a foam-forming binder. One or more of these materials may be employed in an amount (the total amount if more than one are employed) of from 3 to 40% by weight (based on the total product). Of this group of materials, the following are preferred components, particularly when used in the indicated amounts:

| | |
|---|---|
| Modified guar gum | 3 to 40% |
| Locust bean gum | 3 to 40% |
| Starch or modified starch | 3 to 20% |
| Xanthan gum | 3 to 20% |
| | % based on total product |

(5) $CaCO_3$, $MgCO_3$, bentonite clay, $Al_2O_3$, hydrated alumina, silicates, ZnO, $TiO_2$, diatomaceous earth and molecular sieves. One or more of these materials may be employed in an amount (the total amount if more than one are employed) of from 20 to 75% by weight (based on the total product). Of this group of materials the following are preferred components, particularly when used in the indicated amounts (the amount employed of any particular component will ordinarily be less than 20% by weight although a combination of these materials may be employed in amounts up to at least 20% by weight):

| | |
|---|---|
| $CaCO_3$ | 20 to 75% |
| $MgCO_3$ | 5 to 30% |
| Bentonite | 0.5 to 3% |
| | % based on total product |

(6) Sugars, plasticizers and/or humectants, such as sucrose, reducing sugars, glucosamine, honey, corn syrup, glycerine, triethylene glycol, diglycerol and diglycerol tetraacetate and esters of sugars with $C_2$–$C_8$ carbon atom carboxylic acids. One or more of these materials may be employed in an amount (the total amount if more than one are employed) of from 1 to 15% by weight (based on the weight of total product). Of this group of materials, the following are preferred components, particularly when used in the indicated amounts:

| | |
|---|---|
| Sugar | 1 to 10% |
| Glucosamine | 1 to 5% |
| Glycols (except ethylene glycol) or glycol acetates | 1 to 10% |

(7) Urea, amides, proteins, and amino acids, such as soy, peanut, gelatin, whey, blood, or the like protein, or protein hydrolysates; arginine, aspartic acid, isoleucine, lysine, proline, serine, threonine, valine, cysteine, glutamic acid, methionine, alanine, histidine, leucine, phenylalanine, tryptophane, tyrosine, glycine or their browning (Maillard) reaction products with reducing sugars (see *Journal of Agriculture and Food Chemistry*, Volume 16, No. 6, pages 1005–8, 1968, incorporated herein by reference, for discussion on Maillard reaction products). One or more of these materials may be employed in an amount (the total amount if more than one are employed) of from 0.5 to 10% by weight (based on the total product). Of this group of materials, the following are preferred components when used in the indicated amounts (the amount employed of any particular component may be less than 0.5% by weight provided that a combination of these materials is employed such that the total amounts to at least 0.5% by weight):

| | |
|---|---|
| Protein or hydrolysate | 0.5 to 7% |
| Amino acids | 0.2 to 2% |
| Amides or urea | 0.5 to 5% |

(8) Chitin, oxidized chitin, chitosan and its salts, and deproteinated shells of crustacea which contain these materials are also desirably used in the smoking product of the present invention. These materials further enhance and maintain certain desirable and acceptable tobacco-like flavor and aroma characteristics of the smoke. Additionally, they further aid in the reduction of tars and nicotine.

More particularly, the formulations containing chitosan binder offer process improvements in that the materials do not stick to the processing equipment or to themselves during normal processing conditions at the cutting and cigarette-making equipment, and in addition, possess good strength, both in the wet and dry state.

Chitin, in particular, may be used as a flavorant. Contrary to most flavor additives used in the prior art which are volatile thereby being either lost of transferred during storage of the final product, or alternatively, released during the act of smoking at an uncontrolled rate, the use of chitin as a flavorant is highly effective in that the flavor components are generated only thermally or pyrolytically, i.e., during the smoking/burning of the smoking article. Consequently, the flavor is released at a controlled rate, does not affect the pack aroma and is not lost or transferred during storage.

These flavor precursors affording tobacco-like flavor include chitin, oxidized chitin, chitosan, their hydrolyzates, glucosamine, the browning reaction products of any of the foregoing with reducing sugars, ground deproteinated shells of crustaceans such as crab, shrimp, lobster, crayfish, etc., or deproteinated and ground skeletal components of various anthropods, invertebrates and fungi which contain high amounts of chitin. The aforementioned tobacco flavor precursors are added to the smoking substrates by spraying, coating, dipping or dry-blending techniques or by making films which are then blended with the smoking fillers or films of the present invention. The particular chitin-type product, the amount used, and its particular function are set forth in the table below.

| Material | Amount Used In Final Product | Function |
|---|---|---|
| 1. Chitosan | 5–80% | Binder, adhesive, flavorant |
| 2. Chitin | 0.5–60% | Flavorant |
| 3. Deproteinated shells of crustacea | 10–80% | Filler, flavorant |
| 4. Chitin, chitosan hydrolyzates | 0.5–20% | Flavorant |
| 5. Oxidized chitin in the form of dialdehyde | 5–60% | Binder, adhesive, flavorant |

Where desired, it is also possible to use the "pyrolysate" of chitin-type ingredients set forth above. The pyrolysates of these materials are formed by heat treating them at a temperature over 250° C., preferably 300° to 700° C. for a short residence time in an inert or reducing atmosphere, such as nitrogen, helium, vacuum (with or without the presence of a reducing sugar), etc. The pyrolyzed product, which either is distilled over or swept off the pyrolysis furnace with nitrogen or other inert gas, is collected in a cold trap and the whole "mass" is then used to flavor the smoking material.

The level of pyrolysate used varies from a few parts up to 25% and preferably ranges from 0.5 to 10% based on the total weight of the filler. Cigarettes containing these pyrolysates were found to be more tobacco-like and much richer in tobacco-like smoke characteristics.

To further reduce the total particulate matter in the resulting product, i.e., the tar, nicotine, etc., and the puff count, it may be desirable to introduce heat treated carbohydrate material or activated carbon in combination with the cellulosic material described above. These supplemental materials may be used in even higher concentrations than those preferred for the cellulosic materials alone. Thus, they may be present in the final formulation at a concentration as high as 80% of the final filler weight (dry weight basis).

More particularly, suitable carbohydrate materials that may be subjected to heat degradation and be applicable for the present invention include the materials set forth above, i.e., cellulose, starch, modified cellulosics such as oxycellulose, a carboxymethyl cellulose, methyl ethyl and similar celluloses, modified starches, gums such as guar, arabic, pectins, alginic acid, etc., and may also include materials such as wood, plant parts, coffee hulls and peanut hulls. Synthetic polymer materials such as polyacrylic acid may also be heat treated and employed in the present invention.

The heat-treated carbohydrate material is prepared by subjecting the material to thermal degradation at a temperature at about 150° to 700° C. for periods ranging from ½ minute to 72 hours or more, depending on the treatment temperature and the weight loss desired. Preferably, however, the temperature is between 250° and 500° C. and the residence time is from about 1 minute to about 2 hours.

The heat treatment is carried out to the extent that the carbohydrate material experiences a weight loss of at least 10% and preferably from 50 to 90%.

The heating of the carbohydrate material may take place in an oxidizing atmosphere, such as air, up to a temperature of about 250° C., or may alternatively be carried out in an inert atmosphere such as nitrogen, carbon dioxide, helium and the like. Preferably, beyond a temperature of 250° C., only an inert or a reduced atmosphere will be employed. This is to ensure that oxidation or burning of the carbohydrate material does not take place, but rather pyrolytic degradation.

Additionally, where a heat treated carbohydrate material is used, it may be impregnated with sodium or potassium salts of various organic ($C_1$ to $C_8$) or inorganic acids ($H_xPO_y$, $H_2CO_3$, etc.) to further increase the tar reductions of the smoking products that contain this type of filler, and to improve the subjective taste characteristics of the smoke.

The calcium, magnesium, iron and aluminum water-soluble salts which may be employed in the present invention include particularly such salts as calcium lactate, magnesium lactate, aluminum lactate, calcium acetate, magnesium acetate, aluminum acetate, calcium chloride, magnesium chloride, aluminum chloride, and other water-soluble calcium, magnesium, iron and/or aluminum salts of the following:

(a) Organic acids having 1 to 14 carbon atoms in their molecules, preferably 1 to 8 carbon atoms, such as, formic, acetic, propionic, butyric, valeric, methylvaleric, isovaleric, hexanoic, heptanoic, octanoic, benzoic, phenylacetic, citric, malic, tartaric, gluconic, malonic acid and its lower alkyl derivatives such as methyl, dimethyl, ethyl, sec-butyl malonic acids, etc. The acids are normally used as blends of more than one acid for the impregnation of the cellulosic substrate. They are added either as the K, Mg, Ca, Al, Fe salts or in the acid form and then converted to the aforementioned salts while in the slurry. The amounts used vary and are in the range of 0.5 to 15% total organic acids ($C_1$ to $C_{14}$) of the final sheet weight, and/or (b) inorganic acids including hydrochloric, sulfuric, phosphuric and carbonic acids.

The hydrochloric, sulfuric, and phosphoric acids may, in many instances, be added into slurry/water to treat the cellulose. They are then neutralized with Mg or Ca ions. Customarily, however, they are added as the K, Na, $NH_4$, Mg, Ca, Al and Fe salts. These particular acids are used in amounts up to about 20% of the final sheet weight. The carbonic acid, however, is customarily added to the slurry in salt form as K, Na, $NH_4$, Mg, or Ca carbonate in the range from about 5 to 60% (calculated as $H_2CO_3$) of the final sheet weight.

The magnesium, calcium and/or aluminum or iron water-soluble salts may be used in an amount of 0.05 to 15 parts by weight but are preferably used in an amount of from about 0.3 to about 9 parts by weight, and most preferably from about 0.5 to about 4.5 parts by weight, of the final product.

Where the cellulose is in sheet form, either with water-insoluble fillers, such as the calcium or magnesium carbonates, alumina, titanium dioxide, zinc oxide, etc., or without fillers, the cellulose is treated with a slurry, suspension or the like, preferably an aqueous slurry, of the salts which are employed in accordance with the present invention. The slurry will contain the indicated number of parts of the water-soluble salt of calcium, magnesium, aluminum or iron and may also contain additional materials as set forth subsequently in this specification.

While the cellulose, either in sheet or particulate form, may simply be impregnated with the calcium, magnesium, iron or aluminum water-soluble salts of the organic and/or inorganic acids which are employed in accordance with this invention, their impregnation in the cellulose may also, if desired, be followed by: (1) adding an acid capable of producing a water-insoluble salt by reaction with the water-soluble salts, (2) treatment with ammonium and/or alkali metal salts of various acids capable of precipitating the metal or metals present in the water-soluble salts, or (3) treatment with hydroxides, such as KOH, NaOH, LiOH or with $NH_4OH$.

The purpose and advantage of using either treatments (1), (2) or (3), respectively, are as follows:

A good penetration of the cellulose matrix with the water-soluble salts of Ca, Mg, Al and Fe of the present invention, and a very good distribution of the said salts in the cellulose matrix is desired for controlling the uniform burning of the substrate (cellulose), and for making the resultant smoke mild and less acrid. Cellulose fibers possess a certain capacity for absorbing a limited amount of Ca, Mg, Al and Fe ions. This amount, however, may be less than that which is desired to achieve the best results. As a result, in order to "fix" the desired amounts of the aforementioned ions to the cellulosic substrate and prevent them from being leached from the substrate, at least one of steps (1), (2) and (3) is preferably employed. Any one of these three treatments can be employed to uniformly precipitate or reduce the water solubility of the Ca, Mg, Al and Fe ions within the cellulose matrix and prevent their being leached during subsequent slurry treatments. The end result is the production of a cellulose-based tobacco substitute smoking material having acceptable burning and smoke characteristics. Moreover, the uniform distribution of the said ions (Ca, Mg, Al, Fe) in the cellulose matrix provides reaction sites for the uniform fixation of acetic-type flavor components and/or for the uniform "bridging" of various anionic resins (gums, binders), such as pectins, alginic acid, carboxymethyl cellulose and their salts, etc., and thus form a water-insensitive material of acceptable strength, burn rate, and desirable flavor and aroma. In addition, treatment (2) provides an opportunity to introduce certain cations, such as alkali metals, if desired. Treatment (3) permits the incorporation of multivalent ions, in base or base anhydride form, to remain as such or to be available for subsequent reaction with acids introduced later, e.g., for flavoring purposes, when desired.

More specifically, with respect to treatment (1), suitable acids and the amount of such acids which may be employed in the present invention include:

| | Number g-equivalents/ mole of acid |
|---|---|
| Orthophosphoric acid ($H_3PO_4$) | 3 |
| Metaphosphoric acid ($HPO_3$) | 1 |
| Pyrophosphoric acid ($H_4P_2O_7$) | 4 |
| Oxalic acid | 2 |
| Malic acid | 2 |
| Citric acid | 3 |
| Tartaric acid | 2 |
| Carbonic acid | 2 |

It will be recognized that Ca and Mg have two equivalents per mole of Ca or Mg. Al (and Fe also, ordinarily) has three equivalents per mole. The amounts of the acids used depends on the amount of the Ca, Mg, Fe or Al present.

The amount of the acids used are such as to be equivalent to that of the Ca and/or Mg and/or Fe and/or Al, to balance the negative and positive charges of the ions; e.g.:

$$3Ca^{++}+2PO_4^{\equiv}\rightarrow Ca_3(PO_4)_2$$

$$Al^{+++}+PO_4^{\equiv}\rightarrow AlPO_4$$

$$Ca^{++}+2PO_3^{-}\rightarrow Ca(PO_3)_2$$

etc.

These acids are normally used to precipitate or substantially reduce the water solubility of the Ca, Mg, Fe and Al ions and thus eliminate or reduce the transformation of the ions from the cellulosic matrix to the slurry especially in the case that much water (more than the cellulosic matrix can hold) is used to solubilize the binders, and *more especially* in the cases where the binders are a low methoxy pectin and/or alginic acid or their Na, K, $NH_4$—salts. In these cases, if the polyvalent cations (Ca, Mg, Fe, Al) are present in a water solution, they will gel the slurry prematurely by chelating the cations with the corresponding acids (alginic, pectic) and thus produce a non-castable slurry.

Also, by precipitating the Ca, Mg, Fe, Al ions or by reducing their water solubility, their migration to the surface of the sheet during the drying process is eliminated or minimized, thus a sheet is produced with a more uniform distribution of the said ions throughout its matrix.

More specifically as to treatment (2), suitable materials and the relative amounts of ammonium and/or alkali metal salts of various acids capable of precipitating the metal or metals present in the water-soluble salts are set forth below, as well as the reasons for utilizing this treatment in comparison with the other treatments set forth herein:

| | |
|---|---|
| Mono- and/or di- and/or tri-ammonium -sodium -potassium | phosphate(s) |
| Ammonium and/or sodium and/or potassium metaphosphate | |
| The ammonium and/or sodium and/or potassium salts of pyrophosphoric acid | |
| The ammonium and/or sodium and/or potassium | silicates, oxalates, malates, citrates, tartrates, carbonates, bicarbonates |

The amounts used are such as to neutralize the cation equivalents (Ca, Mg, Fe, Al) with an equal number of anion equivalents of the aforementioned salt anions, e.g., $$2K_3PO_4+3Ca^{++}\rightarrow Ca_3(PO_4)_2+6K^{+}$$

$$K_2CO_3+Ca^{++}\rightarrow CaCO_3+2K^{+}$$

etc.

The reasons are the same as for the preceding case, with the additional object of introducing certain monovalent ions which help to change burn characteristics or the like.

Finally, more specifically with respect to treatment (3), the slurries may also be subsequently treated with hydroxides. The amounts of these materials and the advantages for their use are set forth below:

The amount used should be such to convert the Ca, Mg, Fe, Al ions to $Ca(OH)_2$, $Mg(OH)_2$, Al(OH)3, respectively.

Two gram mole equivalents of $NH_4OH$, NaOH, KOH, LiOH is needed per gram mole of Ca or Mg present. Three gram moles of the $NH_4$, K, Na or Li hydroxides is needed per gram mole of aluminum present. The reasons for tying up the ions, discussed above, is to fix them in the cellulosic material, to maintain their uniform distribution and to prevent their premature gelling or cross-linking action on the ionic gums.

As an alternative to the post-treatments described above, and as an even more desirable embodiment of the present invention, it is also possible to employ these treatments as pre-treatment steps. Thus, prior to the addition of the water-soluble metal salts, the cellulose may be pretreated with either of treatments (1), (2), or (3) described above. The employment of any one of these treatments as a pre-treatment step, instead of a post treatment step, not only provides for the advantages discussed above, but in addition thereto, also provides for further desirable effects to take place. Thus, the use of treatment (3) described above causes the cellulose crystalline segments to "swell" due to the chemical reduction of the hydrogen bonds contained therein. This allows for the Ca, Mg, Al and Fe ions to penetrate the cellulose matrix much easier thereby enabling uniform precipitation of $Ca(OH)_2$, $Mg(OH)_2$, $Al(OH)_3$, and $Fe(OH)_3$ or $Al_2O_3$ and $Fe_2O_3$ within the cellulose. With respect to treatments (1) and (2), the additives thereof penetrate the cellulose substrate and increase its ionic exchange capacity. As a result therefore, the Ca, Mg, Al and Fe ions subsequently added are extracted from the water solution to the substrate where an ion exchange takes place such that they are uniformly precipitated within the cellulosic matrix.

More specifically, the pretreatment of the cellulose with $NH_4$ and/or Na and/or Lj hydroxides causes the cellulose to swell, reducing its crystallinity by reducing hydrogen bonds and this makes the penetration of the cellulosic matrix with the water soluble salts of Ca, Mg, Fe and/or Al easier to achieve. After the transfer of the Ca, Mg, Fe, Al ions in the swelled cellulose matrix, the Ca, Mg, Fe, Al ions preciptate as hydroxides. Similarly, by pretreating the cellulose with the aforementioned acids or the ammonium, sodium, potassium, lithium salts of the said acids that are capable of precipitating the Ca, Mg, Fe, Al ions, the cellulose which contains the said acid(s) or salt(s) becomes a stronger type of an "ion exchange" material capable of absorbing and precipitating out of solution the desired amounts of the Ca, Mg, Al ions in the cellulose matrix.

This property gives process flexibility for a continuous and batch type operation, especially if the remaining ions which are now water soluble are to be washed off the cellulose leaving only the cellulose with the desired precipitated salts of Ca, Mg, Fe, Al.

In the case where cellulose is used in combination with an ionic gum (binder) such as pectic and/or alginic acid or the $NH_4$ and/or K and/or Na-salts of these acids, and/or with a gum that can be converted to the ionic form, such as is the methylated pectin which can be hydrolyzed with a base or a basic material to the corresponding pectate or pectic acid, the following techniques are used in making the tobacco substitute in order to prevent the premature "gellation" or crosslinking (bridging) of the particular ionic groups of the gum with the polyvalent cations, in this case being the Ca, Mg, Fe and/or Al. The following approaches, when properly applied, improve the processability of the material and results in sheets which are free of cracks.

In particular, the approaches are: (1) Treat the cellulose as per any of treatments (1)–(3) discussed above with the desired ions and loadings and with a minimum amount of water that is required to impregnate the cellulose without extracting the ions. Then add this material to the pectic and/or alginic acid (or other ionic gum) slurry while mixing. The particular gums are in a water-soluble salt form ($NH_4$ and/or K and/or Na). Then mix this slurry, cast and dry. (2) A second approach to facilitate the processability is to treat the cellulose as per any of treatments (1)–(3) and introduce a non-ionic gum such as guar gum and/or locust beam gum, "Methocel" methyl cellulose (Dow Chemical Company, Midland, Mich. 48640), etc., and then add this mixture to the water-ionic gum slurry (such as Na-pectate, alginate, etc.); mix, cast and dry. The non-ionic gum in this case prevents or reduces substantially the premature availability of the polyvalent cation to come in contact and crosslink with the ionic gum. The starting material for impregnation may be: (a) alpha-cellulose or other cellulosic fibrous material, (b) paper which contains 0–50% of a water-insoluble material such as alpha-cellulose and $CaCO_3$.

When employed in a slurry process, as described above, the cellulose is preferably employed in fiber form. Thus, the cellulose fibers are first loosened and slightly beaten in a Valley beater or, alternatively passed through a commercial plate refiner such as a Sprout-Waldron refiner in pulp form to produce a cellulose pulp having a standard Canadian freeness of no more than 800 ml and preferably below 600 ml with the desired range being 300 to 600 ml. Although the most preferred way of employing the cellulose in the present invention is as a refined pulp, if desired, the cellulose may be employed in the form of a powder, in sheet form, or may be utilized in other forms which may be cast, extruded or the like.

As stated earlier, additional material may desirably be added to the cellulose to enhance the desired resulting properties. These materials include the following:

Calcium carbonate may be incorporated in the form of a finely-divided powder, such as the precipitated calcium carbonate smaller than 2 microns, or, preferably, ground calcium carbonate having an equivalent spherical diameter smaller than 300 microns, preferably 2–250 microns and 45% of the calcium carbonate has an equivalent spherical diameter larger than 10 microns and preferably larger than 30 microns but smaller than 300 microns, in the slurry to provide an ultimate sheet having from about 10 to 75 parts by weight, and preferably from about 30 to 70 parts by weight of the calcium carbonate.

The size and the configuration of the calcium carbonate is critical. Thus, no more than about 30% of calcium carbonate with a particle size diameter smaller than 2 microns should be present in the final product. It is preferred that the average equivalent spherical diameter of the calcium carbonate be greater than 10 microns and preferably greater than 30 microns but below 300 microns and preferably below 250 microns for the following reasons:

1. Where the particle size equivalent spherical diameter is greater than 300 microns, process difficulties are encountered during the slurry casting/extrusion process and the sheet becomes streaky, or in the case of extruding filaments, the die is obstructed by the large calcium carbonate particles.

2. Where the calcium carbonate particle size equivalent spherical diameter is below 2 microns, the calcium carbonate can only be used successfully to produce optimum results if its total weight in the ultimate sheet does not exceed the 30% level and preferably the 20% level. At higher weight levels, the effect of this finely-divided salt on the subjective character of the smoke will be such as to produce a product having a very low impact, body, and a bland flavor and total taste. This is particularly true and even more detrimental in the smoking article which also contains tobacco as part of its blend. In such case, the tobacco smoke character and flavor are reduced disproportionally to that which would be expected by the mere tobacco blend dilution with the tobacco substitute. This effect, in many cases, depending on the amount of the finely-divided calcium carbonate and its average particle size used, is such that even a 10% use level of the tobacco substitute in the tobacco blend is enough to "wipe-off" any tobacco-like taste of the smoking article. As a result of using the coarser material, however, a greater degree of tobacco blend dilution (replacement) can be achieved without substantially altering the total smoke taste characteristics of the smoking article.

3. In addition, where the ultimate smoking material contains 20–75 parts by weight and preferably having from about 30–70 parts by weight of calcium carbonate, the coarser material is preferred in order to maintain acceptable sheet/shred properties such as is strength, filling capacity, flexibility, and to also improve the processability of the material at the cutters (shredders), cigarette making equipment and to reduce dustiness. If a finely divided calcium carbonate is used at the aforementioned high product levels, then the binder used is diluted by the excessive surface area of the fine calcium carbonate to the point that the produced sheet has no strength and flexibility, it is dusty, does not burn well, and has a "plaster-like" texture and appearance. It is also very difficult to cut and make smoking articles such as cigarettes from a blend containing the fine $CaCO_3$ at the high levels indicated.

4. A small amount, preferably less than 30 parts of the ultimate sheet, of finely-divided calcium carbonate is needed, however, for a more uniform burn and ash appearance of the produced ash.

5. Economic advantages are also evident by using the coarser salt since it is cheaper; and moreover, a greater quantity can be used in the final product to reduce the various combustibles (cellulose, gums, binders) at no expense to the desirable filler physical properties, quality of smoke, and processability.

Bentonite clay or other materials such as talc (magnesium silicate) and the other silicates (calcium, sodium, etc.) may also be incorporated in the slurry in an amount of from about 0 to about 3 parts by weight, but it is preferably incorporated in an amount from about 1 to 2 parts by weight.

Potassium or sodium salts of low molecular weight organic acids and/or inorganic acids, may also be employed. These include, potassium or sodium formate, acetate, propionate, butyrate, isobutyrate, valerate, isovalerate, caproate, citrate, malate, tartrate, sorbate, adipate, malonate and the salts of malonic acid derivatives such as the Na, K, $NH_4$ salts of methyl, dimethyl, ethyl, sec-butyl malonic acids, etc., carbonate, bicarbonate, chloride, sulfate, bisulfate, di- and tri-potassium phosphate, aluminate, etc., and may be incorporated in the slurry to provide from about 0 to about 5 parts by weight of the ultimate composition, preferably from about 0.5 to 3.0.

Potassium sorbate or other materials such as potassium benzoate, calcium propionate or sorbic acid may be employed in an amount from about 0 to 5 and preferably from about 0.2 to 0.3 parts by weight as preservatives.

Humectants may also be employed in an amount from about 0 to 10 parts by weight and preferably from 0 to 6 parts by weight of the final product.

Other materials which may be in the composition to make it effective are: Dolomite, $MgCO_3$, $Al_2O_3$, $TiO_2$, ZnO, $FeCl_3$ Fe citrate, Fe ammonium citrate or tartrate, urea, "Methocel," "Klucel," curdlan, propylene glycol alginate, guar and/or other gums; sugar (dextrose, sucrose, glucosamine, etc.); humectant (glycerin, triethylene glycol, diglycerol, diglycerol tetracetate, etc.); food colors; or $CaCO_3$ up to 30% level with a particle size smaller than 2 microns.

Another aspect of the present invention resides in foaming the slurry containing the above described ingredients. This involves the use of a blowing or foaming agent which is contacted with the slurry. The cellulose is preferably in the form of loose and slightly beaten fibers. The slurry may be foamed prior to its being cast as a sheet, whereby an expanded product is obtained or the foaming/blowing agent(s) may more desirably be employed in a manner whereby the slurry is not foamed prior to its casting or extrusion but after. This is to insure a more uniform casting or extrusion of the slurry and to prevent the premature rupture of the foam cells at the die or casting knife. The foaming of the cast slurry may then take place after the slurry is extruded or cast for drying or during the drying process depending on the particular blowing or foaming agent used.

The slurry may be prevented from being prematurely foamed by the type of blowing agent used, the temperature of the slurry, or the pressure that is applied to the slurry in order to keep the added and/or generated gas uniformly dissolved in the slurry in a manner resembling carbonated beverages. Preferred foaming/blowing agents include the following:

1. Steam, air, nitrogen, or other inert gas(es).
2. Carbon dioxide.
3. Ammonium carbonate, ammonium carbamate, azides and hydrazides (which may be decomposed with heat or a suitable acid).
4. Volatile hydrocarbons, such as pentane, hexane or heptane, and chlorofluorocarbons.
5. Peroxides, such as hydrogen peroxide with or without decomposition catalysts, such as, iron, hemoglobin, $NH_4OH$, etc.
6. Azodicarbonamide and other compounds releasing nitrogen gas upon thermal decomposition.

The most effective method for producing a foam when employing the present compositions is to proceed as follows:

1. The slurry is first prepared by mixing the various formula ingredients with water.

2. The slurry is then allowed to cool to below 40° C., 1–6 parts of $(NH_4)_2CO_3$ is then incorporated into the cooled slurry prior to transfering the slurry with a pump to the extrusion line for casting.

3. A variation to Step 2 to allow greater utilization of foaming agents is to prepare the slurry as per Step 1, then transfer the mixed slurry with a pump to the extrusion line and finally to the casting head. At this point, and just a short distance before the casting/extrusion head, the blowing/expanding/foaming agent is metered into the inline slurry and thoroughly mixed therein under pressure to prevent the premature foaming of the slurry in the extrusion line. To accomplish this, an inline mixer similar to a Kenics static mixer or Oakes mixer may be used. (Other types such as a regular plastics screw extruder with a torpedo mixer could also be used.) These mixers are equipped with a multiple inlet feeding head which allows slurry as well as other additives to be added to the mixer on a continuous basis and in predetermined amounts. The various ingredients are added just prior to the mixing section. The inlets are equipped with check valves that prevent the slurry or other additives and the pressure from "bleeding" back into the feeding inlets. At the extrusion end of the mixer, a flow restriction device is used to increase and maintain the head pressure and to also prevent the slurry from being blown off the end of the extruder head. The pressurized slurry is thus prevented from being prematurely foamed in the cases where the foaming/blowing/expanding agents are gaseous materials or have been converted to such with heat and/or an acid addition.

4. The slurry which contains the foaming agent is then cast/extruded to be dried. Foaming of the cast/extruded slurry then takes place either as the slurry is being extruded/cast for drying and/or during the actual drying process depending on the particular foaming agent used. In the case of water, microwave drying of the shaped extrudate will cause the water to evaporate to steam and thereby also causing expansion. NOTE: When in Step 2 certain thermally stable blowing agents are used in the slurry, the slurry should be cooled and maintained at a temperature below the agent's decomposition temperature such that, the foaming expansion of the extruded/cast material takes place in the dryers. A more efficient method of decomposing the particular agent in the dryer is when it is done in the presence of a steam atmosphere.

5. The foamed material is then dried to 10–20% moisture and cut or comminuted for use as a substitute in a tobacco product.

The important parameters for the uniform foaming-/expansion process and uniform extrusion/casting of the slurry are:

1. The selection of the foaming blowing agent to be used. This will determine the slurry temperature and the type of equipment to be used. Thus, if $(NH_4)_2CO_3$ is employed as the blowing agent, the slurry is to be maintained below 40° C. and the agent can be added to the slurry in the mixing tank, thus eliminating the need for an inline mixer and pressurization of the slurry since the $(NH_4)_2CO_3$ will decompose with heat in the dryers after the slurry is cast/extruded (when the temperature becomes >40° C.).

2. Where the slurry is foamed by decomposing an agent, for instance, decomposing a carbonate with an acid, then the acid and optionally the carbonate are added to the slurry (which is maintained under pressure) at the inline mixer.

3. The gaseous and volatile materials, such as air, nitrogen, carbon dioxide, chlorofluorocarbon, pentane, hexane, heptane, etc. are always added to the slurry under pressure just prior to the inline mixer which is situated just before the extrusion/casting head. Hydrogen peroxide blowing agent, when used, is also added in a similar manner to the slurry.

4. Water miscible and immiscible powder or liquid blowing agents are added to the slurry through the inlets of the inline mixer with the aid of a metering pump as a water solution/emulsion/dispersion. This is done in the manner described in order to insure the uniform injection of the minute quantities of the blowing agent used to the slurry. In order to stabilize the emulsion/dispersion of the blowing agents in water and prevent their settling or separation, a gum such as the propylene glycol alginate, "Methocel," guar gum, gelatin, etc. and/or a combination thereof is used.

5. The use of thermogelable hydrocolloids (gums) such as the "Methocel" and/or curdlan, a gum produced by fermentation, in small amounts is beneficial since as the slurry which contains the blowing agent is being heated, they thermally set (gel) and encapsulate the foaming agent, preventing it from escaping until the structure has been heated for drying. At this point, the "gas(es)" expands to form a cellular structure. The thermogelable hydrocolloid (gum) sets further and maintains this form throughout the drying process. "Methocel" water solutions gel with heat but the thermogelation property is reversible upon cooling, whereas the curdlan gum-water solution has irreversible thermogelatin characteristics. As a result, care should be taken, especially with the "Methocel," to maintain the temperature of the slurry/sheet above the gelation point throughout the process until the sheet has been dried to 10–20% moisture.

A further aspect of the present invention involves the cross-linking of various constituents contained in the final smoking product. Cross-linking of the smoking material of the present invention provides for the following desirable characteristics:

(a) Increases the strength of the resulting product, both in the wet and dry state, and reduces breakage during normal processing;

(b) Stabilizes and stiffens the material, even at high moisture content or when cased with humectants and flavorants;

(c) Increases the filling capacity of the resulting product when used as a filler thereby reducing the cigarette density and weight while maintaining acceptable cigarette firmness and resistance-to-draw (RTD);

(d) Protects the smoking material from possibly collapsing or softening during smoking;

(e) Reduces the bulk density and compressability of the smoking material at the cutters and cigarette making machine thereby making these materials easier to cut into filler and to make into cigarettes without possible damage to the processing equipment; and (f) Produces a smoking material which is tack-free such that mouth-sticking, filler-blocking and machine build-up with solubilized material during normal filler or wrapper preparation and/or final product preparation is eliminated.

More particularly, as set forth hereinabove, materials which may be contained in or added to the smoking product of the present invention include materials containing hydroxy, NH, and/or $NH_2$ groups such as the glycols, polyols, (polyesters, polyethers), sugars, carbohydrates (cellulose, CMC, and their various salts, etc.), proteins, urea, amino-sugars (chitin, chitosan, etc.) and the like. These materials may be cross-linked with (a) polyfunctional acids (two or more carboxylic groups), (b) acid chlorides of the polyfunctional carboxylic acids (e.g., adipoyl chloride, etc.), (c) acid anhydrides of polyfunctional carboxylic acids, (d) carbonyl chloride, (e) aldehydes and dialdehydes, (f) diammonium phosphates, (g) ketenes, and (h) lactones.

Generally, the reactions that take place between these compounds are known to one skilled in the art and can be controlled to produce products and intermediates of a particular composition and functionality. The ratio of the functional groups of the compounds present in the smoking material and the cross-linking agents which can be added thereto can be manipulated to produce the functionality and the terminal groups of the polymer desired. In addition, the rigidity of the particular polymer can be controlled by the degree of cross-linking and the amount of trifunctional or polyfunctional cross-linking bridges introduced to the polymer.

The polymeric materials made as described above form water-insoluble plastic films or coatings and can therefore function as binders or film formers in the preparation of smoking products.

The cross-linking agents are combined with the other components to form a slurry and then at a desirable point in the processing, such as during the shaping or drying of the material, the components are caused to cross-link or react to produce the desired polymeric material having the aforementioned properties.

Due to the water stability and insolubility, stiffness, etc., that is introduced into the smoking material by the aforementioned reactions and treatments, the smoking materials can be coated, sprayed, and/or impregnated with solutions of polymeric material to provide a protective coating. This coating retains moisture, stiffens and stabilizes the structures, especially those structures which are either expanded or foamed, and increases the strength of the smoking product. Thus, the smoking material can either be sprayed, coated, dipped or impregnated with the cross-linking agents that will polymerize with the saccharides, polysaccharides (cellulose, etc.), proteins, humectants, polyvalent ions, at least one of these materials being present in the smoking material of the present invention.

Rigidity of the final product is controlled by the amount and degree of polyfunctionality of the particular substances used. Generally, the reactions take place at moderate temperatures and time, preferably at 25° to 350° C. and from a few seconds to 120 minutes. In addition, certain catalysts or higher temperatures, or combinations of temperature, concentration, and catalysts can be used to shorten the time needed to achieve the desired results.

Another method for eliminating surface tackiness, improving the tensile strength and decreasing the sensitivity of the various materials to moisture is to render polymers insensitive to water by forming the calcium, magnesium, iron or aluminum soaps of fatty acids. This is accomplished by reacting the calcium, magnesium, iron or aluminum ions with water-soluble or emulsified fatty acids or fatty acid water-soluble salts such as ammonium, potassium, sodium or lithium myristate, palmitate, stearate, oleate, and the like.

The calcium, magnesium, iron and/or aluminum ions react with the fatty acid moiety to form water-insoluble soaps. The hydrophobic moiety of the fatty acid protrudes from the metal ion. This is the moiety that repels the water and/or moisture from the treated substrate.

In the case of polyvalent cations such as aluminum and carbohydrates, the polyvalent cation can also complex with the hydroxy groups of the polysaccharides (cellulose, etc.) through hydrogen bonds and the third valence of the aluminum ion can be bonded with the acid. This action has a dual effect, i.e., that of reducing hygroscopicity of the carbohydrate and that of repelling any moisture with the hydrophobic moiety of the fatty acid. These treatments, in addition to "water-proofing" the resulting product, also introduce lubricity, stiffness, and anti-tackiness or anti-blocking actions.

The amount of such soap to be used in the final product can range anywhere from 0.1 to 5.0% depending upon the degree of "water-proofing" desired, subjective responses, and the particular fatty acid used.

The polyvalent cations such as calcium, magnesium, aluminum, and iron may also complex with the carboxy groups of the polysaccharides, such as pectin, to form a chelate which is also water insensitive.

In preparing a sheet and/or filler from the materials containing the aforementioned polymers, any of the techniques known to one skilled in the art may be used and will be dependent upon the particular polymer's physico-chemical properties such as solubility, melting point, etc. These physico-chemical properties determine whether the materials should be cast, extruded, etc.

A preferred process of the present invention involves the steps of:

(1) incorporating the ingredients in the amounts as set forth above in water;
(2) employing from 40 to 1000 parts of water per 100 parts of total solid materials to form a slurry;
(3) casting/extruding the slurry to form a sheet or a shaped article;
(4) drying the resulting sheet or shaped article of material into a solid film or article; and
(5) cutting or comminuting the film or article for use as a substitute in a tobacco product.

The details of each step of the above process are the following:

Step 1 is carried out at 20°–70° C. at atmospheric pressure for a time sufficient to mix the various ingredients into a slurry and thereafter bringing the slurry to a temperature of about 40° C. and below.

This is particularly desirable in the formulations containing the thermogelable material "Methocel." Customarily, the "Methocel" which has reversible thermogelation characteristics is added into the hot water while stirring, during the slurry preparation. The slurry is then allowed to cool to below about 40° C. This method of adding "Methocel" to the slurry insures its uniform dispersion in the slurry and prevents lumpiness. An alternative method for adding "Methocel" to the slurry to achieve similar uniformity results, comprises preblending the powder with calcium carbonate and/or dry ingredients prior to adding it while stirring into 20°–40° C. water used for the slurry preparation.

Step 2 is carried out at temperature, pressure and time conditions which are the same as those of Step 1.

Step 3 is carried out at 20°–350° C. (normally about 35°–150° C.), at a pressure greater than about 40 psi for longer than 1 second (normally 1–60 seconds).

Step 4 is carried out at 20°–400° C., normally 35°–300° C. at atmospheric pressure or below for a sufficient time to reduce the moisture content of the dried sheet to about 30% or below.

Step 5 is carried out at 20°–200° C. at atmospheric pressure as the dried sheet comes off the belt.

If desired, each step may be modified as follows:

Step 1 slurry may be aged up to 36 hours in a standby tank as may be necessary to insure process continuity.

The "Methocel," propylene glycol alginate, curdlan, or other gum may be added as a water solution/dispersion/emulsion with/without foaming agent in Step 1. If required by the last ingredient, the pressure is increased as for Step 3. This pressure increase can be eliminated altogether should a thermally stable blowing agent be used (stable at temperatures of the slurry) in Step 1. In this case, the slurry of Step 1 is cooled to a temperature below the thermo-decomposition point of the blowing agent desired to be mixed in the slurry in Step 1. Foaming can then take place in the driers during the drying of the sheet at which point the temperature is high enough to thermally decompose the blowing agent into gas(es).

The slurry may contain a stable blowing agent such as a carbonate in Step 1. Then, in Step 3, an acid is introduced to the slurry under pressure (>40 psi) to react with the carbonate and release carbon dioxide which remains in solution with pressure until the slurry exits at the extrusion/casting head and is processed for drying.

Where ammonium carbonate is being used in the slurry (Step 1), the slurry temperature must be below 40° C., normally 30°–40° C. Other blowing agents that may be used in Step 1 in a cooled slurry (below 50° C.) are: the hydrazides, semicarbazides, azides, azodicarbonamide, calcium and/or magnesium salt of azodicarboxylic acid.

Another variation of Step 3 with foaming is to hold the slurry to which air, nitrogen, carbon dioxide, chlorofluorocarbons, pentane, hexane, etc. was added at 20°–40° C. temperature, under pressure greater than about 60 psi (to maintain the blowing agent dissolved/-dispersed and prevent it from expanding) for up to 36 hours. Optionally the slurry may pass through the inline mixer prior to casting.

After the addition/decomposition of the blowing agent at the inline mixer, under pressure, the slurry may be heated to thermogel the "Methocel" and/or the curdlan and thus microencapsulate the blowing agent (gas, liquid, etc.) and make it available for expansion of the sheet at the dryers.

Slurries which are foamed with hydrogen peroxide (with/without catalysts) should not be aged more than 10 minutes from the time of peroxide addition. This is to avoid the degradation of the binder. Otherwise, the original Step 3 conditions hold.

In Step 3, the slurry may also be extruded into strips, flakes, rods, hollow tubes, and other types of shaped items.

In Step 4, microwave energy may be used to dry the extruded/cast slurry.

In Step 5, the sheet may be removed from the belt and taken up on rolls. This material is then, or at a later, date conditioned to a moisture content of 10–20% and cut or comminuted for use as a substitute in a tobacco product.

A new step may also be added between Steps 4 and 5 to reorder with moisture an overdried sheet and thus facilitate its removal from the belt. The reordering procedures used are: either spray a very fine water mist on dried sheet as it lies flat on the belt which in turn is cooled from below with air and/or cold water, or use a steam box to condense steam throughout the cooled sheet (dew point humidification technique). This latter technique is more useful since the sheet surface does not get overwet and the sheet removal from the belt becomes easier.

Another step, Step 6, may also be added. This includes the employment of a rotary-type tobacco dryer which accepts the cut or comminuted sheet and which is then steamed and force-dried to cause the individual pieces to deform and not lie flat. This property is desirable for blending, cutting, cast filler and cigarette making.

It is also possible, due to the particular materials used in the product of the present invention, to mold or extrude the resulting product, if desirable. Such processing techniques are designed to take advantage of the particular properties that characterize certain of the various natural and synthetic polymers described earlier, which polymers possess ionic or nonionic groups in their structure and which lend themselves to various molding and extrusion techniques.

These polymers include the modified cellulose gums, such as, carboxymethyl cellulose and its Na, K, $NH_4$, Ca or Mg salts; methyl cellulose, hydroxypropyl methyl cellulose, hydroxypropyl cellulose, ethyl cellulose, ethyl hydroxyethyl cellulose, hydroxyethyl cellulose, oxy cellulose, and the like. Additionally, pectins, alginic acid and their Na, K, $NH_4$, Ca, and Mg salts are also applicable. Finally, various gums, such as guar, xanthan gum, locust bean, starch, curdlan and their modified versions, such as salts of xanthomonas gum, are all polymers which lend themselves to extrusion techniques.

More particularly, the formulations containing these materials can be wet extruded, dry extruded or be subjected to a combination of these two processes. The type of process is determined by the properties of the particular polymer used in the formulation.

Generally, the wet extrusion process is a reaction spinning or coagulation technique. This technique makes use of the ionic polymers to form chelates which are not sensitive to water. Moreover, by means of this technique, it is possible to take advantage of the property that certain ionic polymers are water soluble at one pH and insoluble at another. In this matter, a water-soluble form of the polymer is used and then is extruded in the desired shape in a water bath of a particular pH that is needed to precipitate the water-insoluble form of the polymer. The technique can also be applied to take advantage of the property that certain polymers are water-soluble and organic solvent insoluble. In such a case, the water-soluble polymer is extruded in a bath that contains the particular organic solvent necessary for coagulation. For those polymers which are water-insoluble and organic-soluble, the reverse procedure is used.

In the dry extrusion technique, certain polymers are dissolved in solvents which are easily evaporated and then extruded into the desired shape. The solvent is evaporated with heat causing the polymer to set.

Generally, with respect to a combination molding and extruding process, certain polymers or slurries with good thermoplastic properties can be processed into smoking materials of the desired shape by virtually all fabrication methods used for plastics, such as, injection and compression molding, blow molding, injection foam molding, vacuum forming, extrusion of film, sheet, foam articles, and filaments using conventional plastic equipment.

Hence, the natural and/or synthetic polymers are selected and formulated to take advantage of the particular properties that characterize the specific polymers and to use the processing technique that specifically fits those properties. More particularly, polymers which are most preferred for a wet extrusion process include pectins; alginates; chitosan; cellulose esters and ethers; and the like. Polymers which are desirable for use in a dry extrusion process include ethyl cellulose; cellulose acetate; etc. Finally, the particular polymers best used in a combination of molding and extrusion techniques include curdlan; cellulose butyrate; hydroxypropyl cellulose; methyl cellulose; carboxymethyl cellulose and various gums such as guar, modified guar, and xanthan.

In the wet extrusion process, where alginate or pectate salts are used, chitin or chitosan may also desirably be used. Chitosan (an amino-sugar polymer) is soluble in water-acid solution, but solidifies or precipitates in a base or organic solvent. Accordingly, a slurry which contains a chitosan may be extruded into a basic bath, into an organic solvent, or a combination of both.

Compositions of the present invention which are presently preferred are set forth below in complete detail:

| Composition A | |
|---|---|
| Alpha-cellulose | 29.0 parts |
| Calcium lactate | 1.95 parts |
| $CaCO_3$ | 41.5 parts |
| NaCMC | 4.8 parts |
| "Methocel" | 4.8 parts |
| Na—polypectate | 9.7 parts |
| $KHSO_4$ | 1.7 parts |
| K—sorbate | 0.25 parts |
| Bentonite | 1.5 parts |
| TEG (triethylene glycol) | 4.8 parts |
| | 100.00 parts |

Composition B

-continued

| | |
|---|---|
| Alpha-cellulose | 28.16 parts |
| Calcium lactate | 1.89 parts |
| $CaCO_3$ | 40.30 parts |
| NaCMC | 4.66 parts |
| "Methocel" | 4.66 parts |
| Na—polypectate | 9.42 parts |
| $KHSO_4$ | 1.65 parts |
| K—sorbate | .24 parts |
| Bentonite | 1.46 parts |
| TEG | 4.66 parts |
| Caramel color | 2.91 parts |
| Foaming agent | air |
| Composition C | |
| Alpha-cellulose | 10.5 parts |
| Mg—acetate | 3.2 parts |
| $KHSO_4$ | 1.8 parts |
| K—sorbate | .3 parts |
| Bentonite | 1.6 parts |
| Urea | 2.1 parts |
| $CaCO_3$ | 57.9 parts |
| Caramel color | 3.1 parts |
| NaCMC | 15.3 parts |
| "Methocel" | 4.2 parts |
| Foaming agent | air |
| Composition D | |
| Alpha-cellulose | 10.5 parts |
| Mg—acetate | 3.2 parts |
| $KHSO_4$ | 1.8 parts |
| K—sorbate | .3 parts |
| Bentonite | 1.6 parts |
| $CaCO_3$ | 57.9 parts |
| NaCMC | 15.3 parts |
| "Methocel" | 4.2 parts |
| Foaming agent | air |

This composition provides for improved subjective smoke characteristics.

| Composition E | |
|---|---|
| Alpha-cellulose | 10.5 parts |
| Mg—acetate | 3.2 parts |
| K—citrate | 1.8 parts |
| K—sorbate | .3 parts |
| Bentonite | 1.6 parts |
| $CaCO_3$ | 57.9 parts |
| NaCMC | 15.3 parts |
| "Methocel" | 4.2 parts |
| Foaming agent | air |

This composition provides for better burning properties in addition to improved subjective smoke characteristics. Less tar also is associated with this composition.

| Composition F | |
|---|---|
| Alpha-cellulose | 3.5 parts |
| Mg—acetate | 3.2 parts |
| K—citrate | 1.8 parts |
| K—sorbate | .3 parts |
| Bentonite | 1.6 parts |
| $CaCO_3$ | 57.9 parts |
| NaCMC | 15.3 parts |
| "Methocel" | 4.2 parts |
| Foaming agent | air |

This composition produces an even milder smoke than compositions A–E.

| Composition G | |
|---|---|
| Alpha-cellulose | 3.5 parts |
| Mg—acetate | 3.2 parts |
| K—citrate | 1.8 parts |
| K—sorbate | .3 parts |

-continued

| Composition G | |
|---|---|
| Bentonite | 1.6 parts |
| $CaCO_3$ | 40.0 parts |
| NaCMC | 15.3 parts |
| "Methocel" | 4.2 parts |
| Foaming agent | air |

This composition has higher filling capability than the compositions set forth above and has greater strength characteristics.

The following examples are illustrative:

EXAMPLE 1

A slurry was made employing water in an amount of 420 parts by weight (this amounted to 190 liters of water). Calcium lactate, 1.95 parts, was dissolved in 200 parts of room temperature (25°–30° C.) water. To this, 29 parts of loose and lightly beaten cellulose fibers were added while mixing the additives. The cellulose absorbed most of the solution and swelled. At this point, 1.7 parts of potassium bisulfate was added to the cellulose mixture followed by the addition of 1.5 parts of bentonite. The slurry became viscous but movable. Triethylene glycol (4.8 parts) sodium CMC (4.8 parts), and potassium sorbate (0.25 parts) were then added. The slurry was then refined by passing it through a Sprout Waldron refiner. While the slurry was being mixed, the balance of the water (220 parts) was added simultaneously with a dry-blended mixture of $CaCO_3$ (41.5 parts) and "Methocel" (4.8 parts). This slurry was mixed for 5–10 minutes and then sodium polypectate (9.7 parts) was added at the vortex of the mixing slurry. After about 15 minutes of mixing, the slurry was ready to be transferred to the head box to be cast. The slurry temperature was 35°–40° C.

The particle size of the cellulose employed and the sizes of the other materials employed were as follows:

1. Alpha-cellulose loose fibers having a Canadian freeness of about 600.
2. The calcium carbonate was a coarsely ground material having a particle size diameter from about 1–200 microns and 50% of the particles were coarser than 30 microns.
3. The remaining ingredients were either powders, crystal or liquid which dissolved in the water.

The slurry was treated by the following steps:

The slurry was initially at 35°–40° C. temperature. It was then pumped to the casting head box to be cast on a continuous stainless steel belt. The slurry was cast to 25 mils in thickness. The cast slurry was then advanced through a series of drying ovens whose temperatures ranged from 100°–250° C. The "slurry" emerged from the ovens as a dried sheet having a moisture content of below about 10%. This sheet was reordered by spraying a fine mist of water to the upper surface of the advancing sheet. The sheet was then removed from the belt at 20% moisture with the aid of a doctoring (scraping) knife. It was subsequently dried to 5–12% moisture, cut or comminuted and baled to be used later on as a substitute for tobacco in the various tobacco products. The sheet weights were 8–12 g/ft$^2$.

The final product composition which resulted from the above processing steps was as follows:

| | |
|---|---|
| Alpha-cellulose | 29.0 parts |
| Calcium lactate | 1.95 parts |

-continued

| | |
|---|---|
| $CaCO_3$ | 41.5 parts |
| NaCMC | 4.8 parts |
| "Methocel" | 4.8 parts |
| Na—polypectate | 9.7 parts |
| $KHSO_4$ | 1.7 parts |
| K—sorbate | 0.25 parts |
| Bentonite | 1.5 parts |
| TEG | 4.8 parts |
| | 100.00 parts |

This composition was employed as a smoking material as follows: The cut or comminuted sheet was humidified (reordered) with steam and/or a fine water mist to about 12–14% moisture and cut into cigarette filler using a commercial tobacco cutter. The shredded material was then made into cigarettes. The cigarettes were 85 mm in length and 25.2 mm in circumference and contained no tobacco.

It was combined with other smoking materials as follows: The cut sheet was blended with tobacco to produce blends having 10, 20 and 30% of material of Example 1 therein. These blends were conditioned to 12–16% moisture, cut into cigarette filler with a commercial tobacco cutter and made into cigarettes using a commercial cigarette maker.

The composition set forth above represents a preferred embodiment of the present invention. The smoke produced by the articles containing the substitute at the 10, 20, 30 and 100% blend level (balance being tobacco) was very mild. Additionally, the blended cigarettes (10, 20, 30% substitute in blend) produced smoke which was tobacco-like in taste whereas the articles that contained a similar filler whose cellulose was not treated as prescribed and/or contained a finely divided calcium carbonate rather than the coarsely ground calcium carbonate, produced unacceptable and harsh smoke characteristics, even at the 10% level of substitute in the blend. The physical properties, burning characteristics and the processability of this material into sheet, cigarette filler, and cigarettes were more acceptable than its counterparts which contained the fine $CaCO_3$ such as precipitated calcium carbonate.

Cigarettes of equal firmness were made from filler prepared from this product and from a commercial cigarette tobacco blend (the latter control cigarettes were attached to a conventional filter whereas the experimental had an inefficient filter). Smoking by machine according to the procedure for FTC standards gave, for the experimental and control, respectively: total particulate matter in smoke, mg/cigarette, 12.0 and 20.8; FTC "tars," mg/cigarette, 10.1 and 16.9; puff count, per cigarette, 5.3 and 8.7; by infra-red analysis of gas phase, mg/puff, carbon monoxide, 2.3 and 1.7; acetaldehyde, 0.15 and 0.10; hydrogen cyanide, not detectable and 0.026.

EXAMPLE 2

A slurry was made employing water in the amount of 420 parts by weight (this amounted to 190 liters of water). Calcium lactate, 1.95 parts, was dissolved in 200 parts of room temperature (25°–30° C.) water. To this, 29 parts of loose and lightly beaten cellulose fibers were added while mixing the additives. The cellulose absorbed most of the solution and swelled. At this point, 1.7 parts of potassium bisulfate was added to the cellulose mixture followed with the addition of 1.5 parts of bentonite. The slurry became viscous but movable. Triethylene glycol (4.8 parts), sodium CMC (4.8 parts), and potassium sorbate (0.25 parts) were then added. The slurry was then refined by passing it through a Sprout Waldron refiner. While the slurry was being mixed, the balance of the water (220 parts) was added simultaneously with the following dry-blended mixture: Caramel color (3 parts of double strength liquid coloring on the formula dry weight solids) to color the sheet brown, $CaCO_3$ (41.5 parts) and "Methocel" (4.8 parts).

This slurry was mixed for 5–10 minutes and then the sodium polypectate (9.7 parts) was added at the vortex at the mixing slurry. In about 15 minutes of mixing, the slurry was ready to be transferred to the head box to be cast. The slurry temperature was 35°–40° C.

The particle size of the cellulose employed and the sizes of the other materials employed were as follows:

1. Alpha-cellulose loose fibers having a Canadian freeness of about 600.
2. The calcium carbonate was a coarsely ground material having a particle size diameter from about 1–200 microns and 50% of the particles were coarser than 30 microns.
3. The remaining ingredients were either powders, crystal or liquid which dissolved in the water.

The slurry was treated by the following steps:

The slurry was at 35°–40° C. temperature. It was pumped to the casting head box to be cast on a continuous stainless steel belt. The cast slurry was 25 mils in thickness. The cast slurry was then advanced through a series of drying ovens whose temperatures ranged from 100°–250° C. The "slurry" emerged from the ovens as a dried sheet having a moisture content of below about 10%. This sheet was reordered by spraying a fine mist of water to the upper surface of the advancing sheet. The sheet was removed from the belt at 20% moisture with the aid of a doctoring (scraping) knife. It was dried to 5–12% moisture, cut or comminuted, and baled to be used later on as a substitute for tobacco in the various tobacco products. The sheet weights were 8–12 g/ft$^2$.

The composition which resulted from the above processing steps was as follows:

| | |
|---|---|
| Alpha-cellulose | 29.0 parts |
| Calcium lactate | 1.95 parts |
| $CaCO_3$ | 41.5 parts |
| NaCMC | 4.8 parts |
| "Methocel" | 4.8 parts |
| Na—polypectate | 9.7 parts |
| $KHSO_4$ | 1.7 parts |
| K—sorbate | 0.25 parts |
| Bentonite | 1.5 parts |
| TEG | 4.8 parts |
| Caramel color* | 3.0 parts |
| | 103.00 parts |

*Product of Sethness Products Company containing about 54% dry weight solids

This composition was employed as a smoking material as follows: The cut or comminuted sheet was humidified (reordered) with steam and/or a fine water mist to about 12–14% moisture and cut into cigarette filler using a commercial tobacco cutter. The shredded material was then made into cigarettes. The cigarettes were 85 mm in length and 25.2 mm in circumference and contained no tobacco.

It was combined with other smoking materials as follows: The cut sheet was blended with tobacco to produce blends having 10, 20 and 30% of material of Example 2 therein. These blends were conditioned to 12–16% moisture, cut into cigarette filler with a commercial tobacco cutter and made into cigarettes using a commercial cigarette maker. The appearance of the sheet, as a result of the use of caramel coloring, was more tobacco-like than that experienced in Example 1.

This composition represents another preferred embodiment of the present invention for the following reasons: The smoke produced by the articles that contained the substitute at the 10, 20, 30 and 100% blend level (balance being tobacco) was very mild. The blended cigarettes (10, 20, 30% substitute in blend) produced smoke which was tobacco-like in taste whereas the articles that contained a similar filler whose cellulose was not treated as prescribed and/or contained a finely divided calcium carbonate rather than the coarsely ground calcium carbonate produced unacceptable and harsh smoke characteristics, even at the 10% level of substitute in the blend. The physical properties, burning characteristics and the processability of this material into sheet, cigarette filler, and cigarettes were more acceptable than its counterparts which contained the fine $CaCO_3$ such as precipitated calcium carbonate.

Cigarettes of equal firmness were made from filler prepared from this product and from a commercial cigarette tobacco blend (the latter control cigarettes were attached to a conventional filter whereas the experimental had an inefficient filter). Smoking by machine according to the procedure for FTC standards gave, for the experimental and control, respectively: total particulate matter in smoke, mg/cigarette, 12.0 and 20.8; FTC "tars," mg/cigarette, 10.0 and 16.9; puff count, per cigarette, 5.3 and 8.7; by infra-red analysis of gas phase, mg/puff, carbon monoxide, 2.3 and 1.7; acetaldehyde, 0.15 and 0.10; hydrogen cyanide, not detectable and 0.026.

EXAMPLE 3

A slurry was made employing water in an amount of 420 parts by weight (this amounted to 190 liters of water). Calcium lactate, 1.95 parts, was dissolved in 200 parts of room temperature (25°–30° C.) water. To this, 29 parts of loose and lightly beaten cellulose fibers were added while mixing the additives. The cellulose absorbed most of the solution and swelled. At this point, 1.7 parts of potassium bisulfate was added to the cellulose mixture followed with the addition of 1.5 parts of bentonite. The slurry became viscous but movable. Triethylene glycol (4.8 parts), NaCMC (4.8 parts), and potassium sorbate (0.25 parts) were then added. While the slurry was being mixed, the balance of the water (220 parts) was added simultaneously with the following dry-blended mixture:

Caramel color (3 parts on a dry weight basis) to color the sheet brown, $CaCO_3$ (41.5 parts) and "Methocel" (4.8 parts). This slurry was mixed for 5–10 minutes and then the sodium polypectate (9.7 parts) were added at the vortex of the mixing slurry. In about 15 minutes of mixing, the slurry was ready to be transferred to the head box to be cast. The slurry temperature was 35°–40° C.

The particle size of the cellulose employed and the sizes of the other materials employed were as follows:

1. Alpha-cellulose loose fibers having a Canadian freeness of about 600.
2. The calcium carbonate was a coarsely ground material having a particle size diameter from about 1–200 microns and 50% of the particles were coarser than 30 microns.
3. The remaining ingredients were either powders, crystal or liquid which dissolved in the water.

The slurry was treated by the following steps:

Air was then incorporated (0.15 $ft^3$/100 lb. slurry) to the slurry with the aid of an Oakes inline mixer under pressure (40 psi) just prior to casting. Oakes Mixer is a continuous automatic mixer which is normally used for the production of cake batter, marshmallow and similar products. It is supplied by the E. T. Oakes Corporation, 26 Commack Road, Islip, Long Island, N.Y. Alternatively, a Kenics inline mixer was also used in place of or in combination with the Oakes mixer. The slurry was at 35°–40° C. temperature. It was pumped to the casting head box to be cast on a continuous stainless steel belt. The slurry was cast to 25 mils in thickness.

The cast slurry was then advanced through a series of drying ovens whose temperatures ranged from 100°–250° C. The cast slurry was then foamed in the dryers to almost double its unfoamed thickness of Examples 1 or 2 for the same sheet weight per square foot. The "slurry" emerged from the ovens as a dried sheet having a moisture content of below about 10%. This sheet was reordered by spraying a fine mist of water to the upper surface of the advancing sheet. The sheet was removed from the belt at 20% moisture with the aid of a doctoring (scraping) knife. It was dried to 5–12% moisture, cut or comminuted, and baled to be used later on as a substitute for tobacco in the various tobacco products. The sheet weights were 6 to 8 g/$ft^2$.

The composition which resulted from the above processing steps was as follows:

| | |
|---|---|
| Alpha-cellulose | 29.0 parts |
| Calcium lactate | 1.95 parts |
| $CaCO_3$ | 41.5 parts |
| NaCMC | 4.8 parts |
| "Methocel" | 4.8 parts |
| Na—polypectate | 9.7 parts |
| $KHSO_4$ | 1.7 parts |
| K—sorbate | 0.25 parts |
| Bentonite | 1.5 parts |
| TEG | 4.8 parts |
| Caramel color | 3.0 parts |
| Foaming agent | air |

This composition was employed as a smoking material as follows: The cut or comminuted sheet was humidified (reordered) with steam and/or a fine water mist to about 12–14% moisture and cut into cigarette filler using a commercial tobacco cutter. The shredded material was then made into cigarettes. The cigarettes were 85 mm in length and 25.2 mm in circumference and contained no tobacco.

It was combined with other smoking materials as follows: The cut sheet was blended with tobacco to produce blends having 10, 20 and 30% of material of Example 3 therein. These blends were conditioned to 12–16% moisture, cut into cigarette filler with a commercial tobacco cutter and made into cigarettes using a commercial cigarette maker. The appearance of the sheet was more tobacco-like. In addition to the Example 1 and 2 cited blends, additional blends with 75% substitute of Example 3 were made.

This method and composition represents still another preferred embodiment of the present invention. The appearance of the tobacco substitute is acceptable (similar to tobacco, brown) and the various blends with 10–75% substitute in the tobacco blend processed well through the cutters and cigarette makers (better than the unfoamed product of Examples 1 and 2) to produce uniform and good quality products. The cigarette weights were also reduced when compared to those that contained the same level of substitute material of Examples 1 and 2 in the blend. Other reasons are similar to Examples 1 and 2.

Cigarettes made as in Example 1 and smoked vs. a like control gave results as follows: total particulate matter in smoke, 11.0 and 20.8; FTC "tars," 8.6 and 16.9; puff count, 4.2 and 8.7; "tar" per puff, 2.0 and 1.94 mg.

EXAMPLE 4

A slurry was made employing water in an amount of 504 parts by weight (this amounted to 228 liters of water). Into part of the water, calcium chloride (2 parts) was dissolved and 9.0 parts of alpha-cellulose in the form of loose and lightly beaten cellulose fibers was then impregnated with this solution. The following ingredients were then added to the impregnated cellulose in the amounts and under the conditions as set forth below:

| | |
|---|---|
| Potassium citrate | 1.0 parts |
| Bentonite | 1.2 parts |
| Triethylene glycol | 6.0 parts |
| Urea | 1.0 parts |
| Caramel color | 2.5 parts |
| Potassium sorbate | 0.3 parts |
| Calcium carbonate | 63.5 parts |
| Potassium/CMC | 10.0 parts |
| "Klucel" | 6.0 parts |

NOTE:
The potassium/CMC and the "Klucel" were added at the end as dry blended entity (together). The water temperature was about 30° C.

The method of addition was the following:

To 50 parts of room temperature water, calcium chloride (2 parts) was added and dissolved with a mixer. To this solution, the 9 parts of cellulose was added and allowed to soak while mixing. Much of the solution water is adsorbed by the cellulose. To this the potassium citrate was added, followed by the remaining ingredients in the above listed sequence. At the point of the calcium carbonate addition and while the calcium carbonate was being added, the balance of 454 parts of room temperature water was added while the slurry was being mixed. Finally, the potassium-CMC and "Klucel" dry blended gums were added at the vortex of the mixing slurry. The mixing process continued for about 10 minutes and the slurry was then pumped to the head box to be cast into an 8–12 g/ft$^2$ sheet (dry weight basis).

The particle size of the cellulose employed and the sizes of the other materials employed were the same as set forth in Example 3.

The slurry was treated by the following steps:

The produced slurry which was at about 45° C. was pumped to the casting section. It was cast on a continuous stainless steel belt which advanced through a series of heated ovens (temperature range 110° to 260° C.). The dried sheet emerged from the ovens having a moisture content below about 10%. This sheet advanced to a humidification (reordering) section in which a fine mist of water was sprayed thereon. The reordered sheet was doctored off the belt with a scraping knife at 20% moisture and cut or comminuted for use as a tobacco substitute in a smoking product.

The composition which resulted from the above processing steps was as follows:

| | |
|---|---|
| Alpha-cellulose | 9.0 parts |
| $CaCl_2$ | 2.0 parts |
| $CaCO_3$ | 63.5 parts |
| KCMC | 10.0 parts |
| "Klucel" | 6.0 parts |
| K—citrate | 1.0 parts |
| K—sorbate | 0.3 parts |
| Bentonite | 1.2 parts |
| TEG | 6.0 parts |
| Urea | 1.0 parts |
| Caramel color | 2.5 parts |

This composition was employed as a smoking material as follows: The cut or comminuted sheet was humidified (reordered) with steam and/or a fine water mist to about 12–14% moisture and cut into cigarette filler using a commercial tobacco cutter. The shredded material was then made into cigarettes. The cigarettes were 85 mm in length and 25.2 mm in circumference and contained no tobacco.

It was combined with other smoking materials as follows: The cut sheet was blended with tobacco to produce blends having 10, 20 and 30% of the material contained therein. These blends were contitioned to 12–16% moisture, cut into cigarette filler with a commerical tobacco cutter and made into cigarettes using a commercial cigarette maker. The appearance of the sheet was more tobacco-like.

This method and composition represents yet another preferred embodiment of the present invention. The smoke produced by the articles that contained the substitute at the 10, 20, 30 and 100% blend level (balance being tobacco) was very mild. The blended cigarettes (10, 20, 30% substitute in blend) produced smoke which was tobacco-like in taste whereas the articles that contained a similar filler whose cellulose was not treated as prescribed and/or contained a finely divided calcium carbonate rather than the coarsely ground calcium carbonate produced unacceptable and harsh smoke characteristics, even at the 10% level of substitute in the blend. The physical properties, burning characteristics and the processability of this material into sheet, cigarette filler, and cigarettes were more acceptable than its counterparts which contained the fine $CaCO_3$ such as precipitated calcium carbonate.

Cigarettes of equal firmness were made from filler preapred from this product and from a commercial cigarette tobacco blend (the latter control cigarettes were attached to a coventional filter whereas the experimental had an inefficient filter). Smoking by machine according to the procedure for FTC standards gave, for the experimental and control, respectively: total particulate matter in smoke, mg/cigarette, 12.0 and 20.8; FTC "tars," mg/cigarette, 10.1 and 169; puff count, per cigarette, 5.3 and 8.7; by infra-red analysis of gas phase, mg/puff, carbon monoxide, 2.3 and 1.7; aceltaldehyde, 0.15 and 0.10; hydrogen cyanide, not detectable and 0.026.

The material was also easy to process into blends/-cigarettes even when used to 75% substitute level.

EXAMPLE 5

A slurry was made employing water in an amount of 504 parts by weight (this amounted to 228 liters of water). Into the water, calcium chloride (2 parts) was dissolved and 9 parts of alpha-cellulose in the form of loose and lightly beaten cellulose fibers were then impregnated with this solution. The following ingredients were then added to the impregnated cellulose in the amounts and under the conditions as set forth below:

| | |
|---|---|
| Potassium citrate | 1.0 parts |
| Bentonite | 1.2 parts |
| Triethylene glycol | 6.0 parts |
| Urea | 1.0 parts |
| Caramel color | 2.5 parts |
| Potassium sorbate | 0.3 parts |
| Calcium carbonate | 63.5 parts |
| Potassium/CMC | 10.0 parts |
| "Klucel" | 6.0 parts |

with the addition of allowing the slurry to cool to about 35° C. To this cooled slurry, 3 parts of $(NH_4)_2CO_3$ (ammonium carbonate) were added and dissolved therein. The slurry was then pumped to the casting head box at a temperature of 35° C. and processed into a sheet as per Example 4.

The particle size of the cellulose employed and the sizes of the other materials employed were the same as set forth in Example 3.

The slurry was treated by the following steps:

The produced slurry which was about 35° C., by allowing the slurry to cool prior to adding the ammonium carbonate foaming agent, was pumped to the casting section. It was cast on a continuous stainless steel belt which advanced through a series of heated ovens (temperature range 110° to 260° C.). The dried sheet emerged from the ovens having a moisture content below about 10%. This sheet advanced to a humidification (reordering) section in which a fine mist of water was sprayed thereon. The reordered sheet was doctored off the belt with a scraping knife at 20% moisture and cut or comminuted for use as a tobacco substitute in a smoking product.

The composition which resulted from the above processing steps was as follows:

| | |
|---|---|
| Alpha-cellulose | 9.0 parts |
| $CaCl_2$ | 2.0 parts |
| $CaCO_3$ | 63.5 parts |
| KCMC | 10.0 parts |
| "Klucel" | 6.0 parts |
| K—citrate | 1.0 parts |
| K—sorbate | 0.3 parts |
| Bentonite | 1.2 parts |
| TEG | 6.0 parts |
| Urea | 1.0 parts |
| Caramel color | 2.5 parts |

Foaming agent was added to the slurry prior to casting while the slurry temperature was below 40° C., actually 35° C. The foaming agent was ammonium carbonate.

This composition was employed as a smoking material as follows: The cut or comminuted sheet was humidified (reordered) with steam and/or a fine water mist to about 12–14% moisture and cut into cigarette filler using a commercial tobacco cutter. The shredded material was then made into cigarettes. The cigarettes were 85 mm in length and 25.2 mm in circumference and contained no tobacco.

It was combined with other smoking materials as follows: The cut sheet was blended with tobacco to produce blends having 10, 20 and 30% of the material produce contained therein. These blends were conditioned to 12–16% moisture, cut into cigarette filler with a commercial tobacco cutter and made into cigarettes using a commercial cigarette maker. The appearance of the sheet was more tobacco-like.

It represents a preferred embodiment of the present invention for the following reasons: the appearance is acceptable and uniformly acceptable cigarettes were made with high speed cigarette making equipment even when the substitute level was 100% (no tobacco). Other reasons are the same as per Examples 1, 2, 3 and 4.

EXAMPLE 6

A slurry was made employing water in an amount of 504 parts by weight (this amounted to 228 liters of water). In 50 parts of room temperature water (about 25°–30° C.), 3 parts of magnesium acetate were dissolved. To this, 10 parts of alpha-cellulose in the form of loose, lightly-beaten fibers was added and allowed to soak while the mixture was stirred (time about 5–15 minutes). To this, the following ingredients were added in the order listed:

| | |
|---|---|
| Potassium bisulfate ($KHSO_4$) | 1.7 parts |
| Bentonite | 1.5 parts |
| Triethylene glycol | 8.0 parts |
| Urea | 2.0 parts |
| K—sorbate | 0.3 parts |
| Caramel color | 3.0 parts |
| $CaCO_3$ | 55.0 parts |
| "Methocel" | 4.0 parts |
| NaCMC | 14.5 parts |

The $CaCO_3$, "Methocel," and NaCMC were dry-mixed prior to adding them as an entity to the remaining mixture. While this dry mixture was added, the balance of the water (454 parts) was added simultaneously to form the slurry. After all the additives had been introduced, the mixing continued for about 10 additional minutes. The slurry temperature at this time was 35°–40° C.

Air was then incorporated (0.15 $ft^3$/100 lb. slurry) to the slurry with the aid of an Oakes inline mixer under pressure (40 psi) just prior to casting. Alternatively, a Kenics inline mixer was also used in place of or in combustion with the Oakes mixer.

The slurry, which was at about 35°–40° C., was then pumped to the casting section. It was cast on a continuous stainless steel belt and dried with heat (100°–260° C. oven temperature range) to a moisture content of about 10%. The sheet was then reordered to 20% moisture by passing the dry sheet through a box which allowed steam to enter over the upper section of the belt which simultaneously was being cooled by sprinkling water on the underside (steam condensed throughout the sheet). The sheet was then removed from the belt with a scraping knife, dried to 5–15% moisture and cut or comminuted into small pieces for use as a tobacco substitute in tobacco products.

The composition which resulted from the above processing steps was as follows:

| | |
|---|---|
| Alpha-cellulose | 10.0 parts |
| Mg—acetate | 3.0 parts |
| $KHSO_4$ | 1.7 parts |
| K—sorbate | 0.3 parts |
| Bentonite | 1.5 parts |
| TEG | 8.0 parts |
| Urea | 2.0 parts |
| $CaCO_3$ | 55.0 parts |
| Caramel color | 3.0 parts |

-continued

| | |
|---|---|
| NaCMC | 14.5 parts |
| "Methocel" | 4.0 parts |

This composition was employed as a smoking material as follows:

Same as for previous examples.

It was combined with other smoking materials as follows:

Same as for Examples 3, 4, and 5.

It represents a preferred embodiment of the present invention for the following reasons:

Same as for Examples 1, 2, and 4.

EXAMPLE 7

The ingredients and procedure of Example 6 were used, except that triethylene glycol was eliminated.

This composition was employed as a smoking material as follows:

Same as for Example 6.

It was combined with other smoking materials as follows:

Same as for Example 6.

It represents a preferred embodiment of the present invention for the following reasons:

Same as for Example 6. In addition, it produced less total tar in the smoke and less gas phase than did the product of Example 3, yets its acceptability as a satisfying smoking product did not drop correspondingly. The following data will demonstrate this.

The cigarettes prepared from this product, at equal firmness vs. those of Example 3 (experimental and control) gave, when smoked by the same procedure, the following values: total particulate matter, 4.3 mg; FTC "tar," 3.9 mg; puff count, 7.6; "tar" per puff, 0.51 mg; by infra-red; CO, 1.13 mg/puff; acetaldehyde, 0.04 mg/puff; hydrogen cyanide, 0.005 mg/puff.

EXAMPLE 8

Same as Example 6 except that triethylene glycol was replaced with glycerin. The particle size of the cellulose employed and the sizes of the other materials employed were as follows:

Same as Examples 6 and 7. The slurry was treated by the following steps:

Same as Examples 6 and 7. The composition which resulted from the above processing steps was as follows:

| | |
|---|---|
| Alpha-cellulose | 10.0 parts |
| Mg—acetate | 3.0 parts |
| $KHSO_4$ | 1.7 parts |
| K—sorbate | 0.3 parts |
| Bentonite | 1.5 parts |
| Glycerin | 8.0 parts |
| Urea | 2.0 parts |
| $CaCO_3$ | 55.0 parts |
| Caramel color | 3.0 parts |
| NaCMC | 14.5 parts |
| "Methocel" | 4.0 parts |

This composition was employed as a smoking material as follows:

Same as Examples 6 and 7. It was combined with other smoking materials as follows:

Same as Examples 6 and 7. It represents a preferred embodiment of the present invention for the following reasons:

Same as Examples 6 and 7.

EXAMPLE 9

The 35°-40° C. slurry which was prepared as per Example 6 was pumped through an Oakes inline mixer which was situated just before the slurry discharge to the casting section. Air was added (0.5 CF 70° F./100 pound slurry/minute) and mixed into the slurry at the mixer, under pressure (>40 psi). The aerated pressurized slurry was then cast into a sheet. The conditions thereafter were identical to those of Example 6. The dry sheets, ranging in weight 8 to 12 g per square foot had a thickness which was 1.5 to 2.0 times the thickness of their unfoamed counterparts of Examples 6, 7, and 8.

The composition which resulted from the above processing steps was as follows:

| | |
|---|---|
| Alpha-cellulose | 10.0 parts |
| Mg—acetate | 3.0 parts |
| $KHSO_4$ | 1.7 parts |
| K—sorbate | 0.3 parts |
| Bentonite | 1.5 parts |
| TEG | 8.0 parts |
| Urea | 2.0 parts |
| $CaCO_3$ | 55.0 parts |
| Caramel color | 3.0 parts |
| NaCMC | 14.5 parts |
| "Methocel" | 4.0 parts |
| Foaming agent | air |

This composition was employed as a smoking material as follows:

Same as for Examples 6, 7, and 8. It was combined with other smoking materials as follows:

Same as for Examples 6, 7, and 8. It represents a preferred embodiment of the present invention for the following reasons:

The material had an acceptable appearance and physical and mechanical properties which made it easily processable into uniform firmness/weight/appearance cigarettes with high speed cigarette making equipment. Other reasons the same as for Example 6.

Cigarettes made from 100% of this product were of equal firmness to control cigarettes (see Example 1). Smoking these cigarettes, with a low-efficiency filter attached, gave by the FTC standard method the following results: total particulates (of which 41% was triethylene glycol humectant), 12.9 mg; FTC "tar," 10.2 mg; puff count, 7.0; acetaldehyde, 0.06 mg/puff; hydrogen cyanide, not detectable.

Similarly, the foamed version of Example 8 is the most preferred embodiment of that Example for the same reasons mentioned above (processability into 100% substitute cigarettes).

EXAMPLE 10

A slurry was made employing water in an amount of 504 parts by weight (this amounted to 228 liters of water). Into 50 parts of water, phosphoric acid (2 parts) was dissolved and 10 parts of alpha-cellulose in the form of loose and slightly beaten cellulose fibers was then impregnated with this solution. The mixture allowed to age for about 10 minutes. To the above mixture after the 10-minute aging and while it was being mixed 20 parts of 20°-30° C. water which contained 3 parts of magnesium acetate and 1.7 parts of potassium bisulfate was slowly added at the vortex. The addition of 1.5 parts of bentonite, potassium sorbate (0.3 parts), triethylene glycol (8 parts), carmel color (3 parts) and urea (2 parts) followed in the sequence indicated. Finally and while the above mixture was being mixed and the balance of the 20°-30° C. water was added (434 parts) the following dry blended ingredients were added as an entity: $CaCO_3$ (55.0 parts), "Methocel" (4 parts), NaCMC (14.5 parts).

The slurry was then mixed thoroughly for about 15-30 minutes and transferred to the casting head box to be cast into a sheet.

The particle size of the cellulose employed and the sizes of the other materials employed were as follows:

The same as for Examples 6, 7, 8, and 9. The slurry was treated by the following steps:

The same as for Example 6 or 9. The composition which resulted from the above processing steps was as follows:

| | |
|---|---|
| Alpha-cellulose | 10.0 parts |
| Mg, Ca phosphate | 2.7 parts |
| $CaSO_4$ | 1.7 parts |
| K—acetate | 1.23 parts |
| K—sorbate | 0.3 parts |
| Bentonite | 1.5 parts |
| TEG | 8.0 parts |
| Urea | 2.0 parts |
| Caramel color | 3.0 parts |
| $CaCO_3$ | 51.5 parts |
| Ca acetate | 2.35 parts |

This composition was employed as a smoking material as follows:

Same as previous examples.

It was combined with other smoking materials as follows:

Same as previous examples.

The smoke was very mild and tobacco-like in smoke character of the cigarettes which were produced with a blend that contained 70% of this filler (the balance being tobacco); whereas a similar filler whose cellulose was not treated in the prescribed manner and/or a filler whose calcium carbonate had an average particle size below 2 micron (such as precipitated $CaCO_3$) produced unacceptable smoke characteristics even when the amount of the tobacco substitute was at 10-20% blend level.

The physical properties, burning characteristics and the processability of this material into sheet cigarette filler and cigarettes were acceptable, whereas a similar material which contained an equal amount of precipitated calcium carbonate (particle size below 1 micron) in place of the coarsely ground $CaCO_3$ produced a "plaster-like" sheet; it was dusty, abrasive, low in filling capacity, and in general it was an unacceptable material.

EXAMPLE 11

A slurry was made employing water in an amount of 504 parts by weight (this amounted to 228 liters of water).

Into the water basic aluminum acetate (2 parts) was dissolved and 10 parts of alpha-cellulose in the form of loose and slightly beaten fibers were then impregnated with this solution. The following ingredients were then added to the impregnated cellulose with or without magnesium acetate (2 parts) prior to adding the remaining ingredients in the amounts and under the conditions as described in the preceding examples.

The particle size of the cellulose employed and the sizes of the other materials employed were as follows:

Similar to previous examples.

The slurry was treated by the following steps:

Similar to previous Examples 6, 7, 8, and 9.

The composition which resulted from the above processing steps was as follows:

| | |
|---|---|
| Alpha-cellulose | 10.0 parts |
| Bentonite | 1.5 parts |
| NaCMC | 14.5 parts |
| Basic aluminum acetate | 2.0 parts |
| TEG | 8.0 parts |
| "Methocel" | 4.0 parts |
| Magnesium acetate (optionally) | 2.0 parts |
| Urea | 2.0 parts |
| $KHSO_4$ | 1.4 parts |
| $CaCO_3$ | 55.0 parts |
| K—sorbate | 0.3 parts |
| Caramel color | 3.0 parts |

EXAMPLE 12

A slurry was made employing water in an amount of 504 parts by weight (this amounted to 228 liters of water).

First, magnesium acetate (2 parts) was dissolved in 50 parts of water 20°-30° C.). To this, 10 parts of cellulose fibers were added (loose and slightly beaten) and soaked for 5-15 minutes while the mixture was stirred. To this, K-citrate, bentonite, urea, K-sorbate, and caramel color in the respective amounts as set forth in the table bwlow were added and mixed therein.

| | |
|---|---|
| Potassium citrate | 1.7 parts |
| Bentonite | 1.5 parts |
| Propylene glycol alginate | 4.0 parts |
| Urea | 2.0 parts |
| K—sorbate | 0.3 parts |
| Caramel color | 3.0 parts |
| $CaCO_3$ | 55.0 parts |
| NaCMC | 7.5 parts |
| Guar gum | 7.0 parts |
| $NH_4$ myristate | 0.5 parts |
| Hexane | 0.5 parts |

The balance of water (454 parts) was added simultaneously with the $CaCO_3$, NaCMC, and guar gum.

The $NH_4$ myristate, propylene glycol alginate was added as an emulsion which was made as follows:

| | |
|---|---|
| Water | 16.8 parts |
| $NH_4$ myristate | 0.5 parts |
| Hexane | 0.5 parts |
| Propylene glycol alginate | 4.0 parts |

This emulsion was added by metering it into the slurry just at the inlet of an Oakes inline mixer just prior to casting while holding the slurry under a pressure of 60 psi.

Cigarettes were made as in Example 9 for test purposes. The results obtained were similar to those obtained in Example 9. This example, therefore, essentially shows the use of hexane as a blowing agent in lieu of air and the comparable results which are obtained.

| PHYSICAL PROPERTIES | | | | | |
|---|---|---|---|---|---|
| Material of Example | Equ. Moisture Percent | Sheet Wt. g/ft$^2$ | Thickness mls | Tensile Kg/in | cc/10 g |
| 1 | 8.0 | 9.0 | 6.0 | 3.0 | 42 |
| 3 | 7.5 | 6.7 | 10.4 | 1.6 | 52 |
| 9 | 10.0 | 11.7 | 10.0 | 1.0 | 32.3 |
| 7 (foamed) | 9.5 | 9.9 | 11.4 | 0.6 | 33 |

PROCESSING

The foamed materials can easily be cut into cigarette filler at the 70–100% blend levels (balance being tobacco), and be made into cigarettes at the 100% blend level with conventional cutting and cigarette making equipment.

| SMOKING DATA 100% Materials | | | | | |
|---|---|---|---|---|---|
| Examples | 1 | 3 | 9 | 7 foamed | Tobacco*** |
| TPM, mg/cig | 12.0 | 11.0 | 12.9* | 4.3 | 20.8 |
| FTC Tars, mg/cig | 10.1 | 8.6 | 10.2 | 3.9 | 16.9 |
| Puff Count | 5.3 | 4.2 | 7.0 | 7.6 | 8.7 |
| Tar/Puff, mg/puff | 1.9 | 2.0 | 1.5 | 0.51 | 1.94 |
| IR - GAS PHASE DATA | | | | | |
| CO, mg/puff | | 2.3 | 1.17 | 1.13 | 1.7 |
| Acetaldehyde, mg/puff | | 0.15 | 0.06 | 0.04 | 0.1 |
| HCN, mg/puff | | ND** | ND** | 0.005 | 0.026 |

*41% of the TPM is TEG.
**Not detectable.
All experimental cigarettes with EC 351 paper (low porosity paper).
***The all tobacco control had a conventional CA-filter and a porous cigarette paper which reduce the tars and other smoke components further.

| SMOKING DATA Of Blended Cigarettes with Filler of Example 9 | | | |
|---|---|---|---|
| | All Tobacco Control | 50% Tobacco 50% #9 Filler | 25% Tobacco 75% #9 Filler |
| TPM, mg/cig | 21.1 | 19.2 | 14.3 |
| Nicotine, mg/cig | 1.09 | 0.83 | 0.3 |
| FTC Tar, mg/cig | 17.01 | 15.97 | 11.9 |
| Puff Count | 8.9 | 9.3 | 7.7 |
| Tar/Puff, mg | 1.98 | 1.71 | 1.55 |
| Humectant Free Tars* mg/cig | 15.41 | 12.37 | 7.5 |
| G-C - PUFF BY PUFF GAS PHASE | | | |
| HCN, mg/cig | 0.18 | 0.10 | 0.06 |
| Total Aldehydes, mg/cig | 1.11 | 0.85 | 0.72 |
| CO, mg/cig | 15.0 | 13.0 | 10.0 |
| NO, mg/cig | 0.40 | 0.22 | 0.12 |
| Number of Puffs/cig | 9.0 | 9.0 | 8.0 |
| IR - GAS PHASE | | | |
| HCN, mg/cig | 0.18 | 0.10 | 0.04 |
| Acetaldehyde, mg/cig | 0.78 | 0.60 | 0.47 |
| CO, mg/cig | 15.9 | 12.2 | 10.2 |
| Number of Puffs/cig | 7.0 | 8.0 | 8.0 |

*Humectant free tars = FTC Tars-Humectant

This calculation was made because much of the tar of filler 9 is triethylene glycol (humectant).

| SMOKING DATA OF FOAMED EXAMPLE #7 IN BLENDED CIGARETTES | | | | | |
|---|---|---|---|---|---|
| | All Tobacco | 20% 7-Foamed 80% Tobacco | 40% 7-Foamed 60% Tobacco | 60% 7-Foamed 40% Tobacco | 100% 7 Foamed |
| TPM, mg/cig | 26.2 | 19.8 | 14.7 | 9.6 | 3.4 |
| Nicotine, mg/cig | 1.63 | 1.22 | 0.84 | 0.49 | |

-continued

| SMOKING DATA OF FOAMED EXAMPLE #7 IN BLENDED CIGARETTES | | | | | |
|---|---|---|---|---|---|
| | All Tobacco | 20% 7-Foamed 80% Tobacco | 40% 7-Foamed 60% Tobacco | 60% 7-Foamed 40% Tobacco | 100% 7 Foamed |
| FTC Tar, mg/cig | 21.3 | 16.1 | 12.3 | 8.2 | 3.2 |
| Puff Count | 10.5 | 9.3 | 8.3 | 7.6 | 6.6 |
| Tar/Puff, mg/puff | 2.03 | 1.73 | 1.48 | 1.08 | 0.49 |
| Percent Reduction | | 14.7 | 27.1 | 46.7 | 76.1 |

All cigarettes were made identically in regard to firmness, RTD, cigarette paper, paper porosity and filtration.

| G-C - PUFF BY PUFF GAS PHASE | | | | | |
|---|---|---|---|---|---|
| HCN, mg/cig | .16 | .13 | .10 | .07 | .03 |
| Total Aldehydes, mg/cig | .81 | .74 | .69 | .52 | .37 |
| CO, mg/cig | 14 | 14 | 13 | 9 | 6 |
| NO, mg/cig | .25 | .20 | .17 | .10 | .03 |
| IR - GAS PHASE | | | | | |
| HCN, mg/cig | .22 | .15 | .10 | .08 | .03 |
| Acetaldehyde, mg/cig | .65 | .60 | .46 | .41 | .20 |
| CO, mg/cig | 17.0 | 15.3 | 11.2 | 11.0 | 7.7 |

EXAMPLE 13

A smoking material was prepared using the following formulation:

| | |
|---|---|
| Heat treated cellulose (thermolyzed to 80% weight loss) | 6.00 parts |
| Mg—acetate | 0.90 parts |
| $KHSO_4$ | 0.51 parts |
| K—sorbate | 0.09 parts |
| Bentonite | 0.45 parts |
| Urea | 0.60 parts |
| Calcium carbonate | 13.90 parts |
| Caramel color | 0.90 parts |
| NaCMC | 6.35 parts |
| "Methocel" | 1.20 parts |

The formulation given above was made into a slurry by employing water in an amount of 420 parts by weight (this amounted to 190 liters of water). Magnesium acetate, 0.90 parts, was dissolved in 200 parts of water at room temperature (25° to 30° C.). To this, 6.0 parts of heat treated cellulose material was introduced while mixing the additives. At this point, 0.51 parts of potassium bisulfate was added to the mixture, followed by the addition of the bentonite and NaCMC (3.0 parts). The slurry became viscous but movable, and it was refined with a Sprout Waldron refiner. Caramel color, urea, potassium sorbate and the balance of the NaCMC were then added. While the slurry was being mixed, the remainder of the water (220 parts) was added simultaneously with the following dry blended mixture; calcium carbonate and "Methocel". This slurry was mixed for five to ten minutes and then the slurry was ready to be transferred to the head box to be cast. The slurry was at a temperature of 35° to 40° C.

It was pumped to the casting head box where it was cast in a continuous stainless steel belt. The cast slurry was 25 mils in thickness. The cast slurry was then advanced through a series of drying ovens whose temperatures ranged from 100° to 250° C. The slurry emerged as a dry sheet having a moisture content of about 10%. This sheet was humidified (reordered) by spraying a fine mist of water onto the upper surface of the advancing sheet. The sheet was removed from the belt at 20% moisture with the aid of a doctoring (scraping) knife. It was then dried to a moisture content of 5 to 12%, cut into cigarette filler and blended in various percentages with commercial tobacco filler to form cigarettes for testing purposes. The result of tests performed are set forth in the tables below.

SMOKING DATA OF EXAMPLE 13 BLENDED CIGARETTES

| | 20% Ex. 13 80% Tobacco | 40% Ex. 13 60% Tobacco | 60% Ex. 13 40% Tobacco | 100% Ex. 13 |
|---|---|---|---|---|
| TPM, mg/cig | 19.6 | 14.6 | 9.0 | 1.4 |
| Nicotine, mg/cig | 1.16 | 0.81 | 0.46 | 0.0 |
| FTC Tar, mg/cig | 15.54 | 11.69 | 7.24 | 1.0 |
| Puff Count, # puffs/cig | 10.5 | 9.7 | 8.9 | 7.8 |
| Tar, mg/puff | 1.480 | 1.205 | 0.814 | 0.128 |
| Nicotine, mg/puff | 0.111 | 0.084 | 0.052 | 0.00 |
| % Reduction, tar/puff | 25.7 | 39.5 | 59.1 | 93.6 |
| % Reduction, nic./puff | 24.5 | 42.9 | 64.6 | 100.0 |

All cigarettes were made identically in regard to firmness, RTD, cigarette porosity and filtration.

| | 40% Ex. 13 60% Tobacco | 100% Ex. 13 |
|---|---|---|
| IR - GAS PHASE | | |
| CO, mg/cig | 17.1 | 11.8 |
| Acetaldehyde, mg/cig | 0.55 | 0.20 |
| HCN, mg/cig | 0.17 | 0.07 |
| Puff Count, # puffs/cig | 9.5 | 7.0 |
| CO, mg/puff | 1.80 | 1.69 |
| Acetaldehyde, mg/puff | 0.058 | 0.029 |
| HCN, mg/puff | 0.018 | 0.010 |
| CO, % change/puff | −4.8 | −10.6 |
| Acetaldehyde, % change/puff | −13.4 | −56.7 |
| HCN, % change/puff | −35.7 | −64.3 |
| PUFF BY PUFF - GAS PHASE | | |
| CN, mg/puff | 0.013 | 0.008 |
| RCHO, mg/puff | 0.057 | 0.035 |
| CO, mg/puff | 1.30 | 1.00 |
| NO, mg/puff | 0.016 | 0.003 |
| Puff Count, # puffs/cig | 10. | 8. |
| CN, % change/puff | −13.33 | −46.67 |
| RCHO, % change/puff | −18.57 | −50.00 |
| CO, % change/puff | −18.75 | −37.50 |
| NO, % change/puff | −42.86 | −89.29 |

EXAMPLE 14

Example 13 was repeated except that instead of the 6 parts of heat treated cellulose material, 6 parts of heat treated Burley stems which were thermolyzed to a 60% weight loss were used. Cigarettes were formed from this material and blended with commercial cigarette filler to form test cigarettes. The results of the tests performed are set forth in the tables below.

SMOKING DATA OF EXAMPLE 14 IN BLENDED CIGARETTES

| | 20% Ex. 14 80% Tobacco | 40% Ex. 14 60% Tobacco | 60% Ex. 14 40% Tobacco | 100% Ex. 14 |
|---|---|---|---|---|
| TPM, mg/cig | 18.8 | 14.0 | 9.0 | 1.9 |
| Nicotine, mg/cig | 0.96 | 0.73 | 0.38 | 0.00 |
| FTC Tar, mg/cig | 15.94 | 11.97 | 7.82 | 1.60 |
| Puff Count, # puffs/cig | 9.2 | 8.4 | 7.5 | 5.9 |
| Tar, mg/puff | 1.733 | 1.425 | 1.043 | 0.271 |
| Nicotine, mg/puff | 0.104 | 0.087 | 0.051 | 0.000 |
| % Reduction, tar/puff | 13.0 | 28.5 | 47.6 | 86.4 |
| % Reduction, nicotine/puff | 29.3 | 40.8 | 65.3 | 100.0 |

All cigarettes were made identically in regard to firmness, RTD, cigarette paper, paper porosity and filtration.

| | 40% Ex. 14 60% Tobacco | 100% Ex. 14 |
|---|---|---|
| IR - GAS PHASE | | |
| CO, mg/cig | 17.0 | 12.0 |
| Acetaldehyde, mg/cig | 0.57 | 0.20 |
| HCN, mg/cig | 0.08 | ND |
| Puff Count, # puffs/cig | 8.5 | 6.0 |
| CO, mg/puff | 2.00 | 2.00 |
| Acetaldehyde, mg/puff | 0.067 | 0.033 |
| HCN, mg/puff | 0.009 | 0.000 |
| CO, % change/puff | +5.8 | +5.8 |
| Acetaldehyde, % change/puff | 0.00 | −50.7 |
| HCN, % change/puff | −67.9 | −100.0 |
| PUFF BY PUFF - GAS PHASE | | |
| $CN^-$, total mg/puff | 0.009 | 0.003 |
| RCHO, total mg/puff | 0.072 | 0.037 |
| CO, total mg/puff | 1.44 | 1.50 |
| NO, total mg/puff | 0.017 | 0.003 |
| Puff Count, # puffs/cig | 9. | 6. |
| $CN^-$, % change/puff | −40.00 | −80.00 |
| RCHO, % change/puff | +2.86 | −47.14 |
| CO, % change/puff | −10.00 | −6.25 |
| NO, % change/puff | −39.29 | −89.29 |

EXAMPLE 15

Sodium alginate (20 pounds) whose structure was rich in D-mannuronic acid units was dissolved into 30 gallons of 120° F. water. To this, 22 pounds of $Ca_3(PO_4)_2$ was added and thoroughly mixed therein to form a slurry.

One half of this slurry was then extruded through a die (a multiple-hole die) into a water-$CaCl_2$ (20% $CaCl_2$) solution bath. The extrudate upon coming in contact with the $CaCl_2$ was set or coagulated into fiber-like material which had a strong jelled skin. The gelled fibers were then removed from the coagulating bath and washed with warm water (40° C.), and finally dried to a 10–20% moisture content by laying them on a stainless steel belt which was then passed through an oven.

The continuous fibers were then cut in ¼" to 1" lengths and blended with tobacco filler to produce the following cigarette blends:

(a) 100% tobacco (control)
(b) 80% tobacco+20% filler of Example 15
(c) 60% tobacco+40% filler of Example 15
(d) 40% tobacco+60% filler of Example 15
(e) 20% tobacco+80% filler of Example 15

These cigarettes were then smoked and found to be tobacco-like in flavor (taste and aroma). They were classified as being mild and not irritating to the throat and nose.

The machine-smoked cigarettes were found to deliver less tars, nicotine, and less of such other components as HCN, aldehydes, $NO_x$, isoprene, etc. than the control cigarette. These reductions were greatest with the highest level of filler of Example 15 in the blend. The candidate with 60% filler of Example 15 and 40% tobacco in the blend delivered 63% less nicotine and 50% less tar per cigarette than the control.

The second one half of the Example 15 slurry was extruded as per the aforementioned method in a $H_2O$-HCl bath (pH=2.5) rather than in $CaCl_2$. It was then processed into filler and cigarettes as above. The results were similar to those described above.

EXAMPLE 16

Na-alginate (20 pounds) whose structure was rich in D-mannuronic acid units was dissolved into 100 gallons of 120° F. water. To this 20 pounds of $Ca_3(PO_4)_2$ and 60 pounds of ground tobacco (particle size <150 microns) was then added and a thick slurry was formed.

One half of this slurry was then extruded into a 20% $CaCl_2$-water bath which also contained 0.2% hydrochloric acid.

The remaining one half of the slurry was cast on a stainless steel belt whose bottom side was immersed into the $CaCl_2$—HCl solution, described above. The cast slurry, upon contacting the $CaCl_2$—HCl solution, was set (coagulated) in a sheet (film) form which was then washed with water and dried in the ovens to 20% OV.

These materials were then cut into ¼" to 1" filler lengths (in the case of the former) and 2"×2" squares (in the case of the sheet).

The fibrous material was blended with tobacco filler at various levels or used by itself to make cigarettes. The sheet material was blended with tobacco or by itself and cut into cigarette filler, using the conventional tobacco cutters, and made into cigarettes.

The cigarettes were smoked and found to be subjectively acceptable and very mild.

EXAMPLE 16a

Na-alginate (20 pounds) whose structure was rich in D-mannuronic acid units was wetted with 10 gallons of 120° F. water. To this 20 pounds of $Ca_3(PO_4)_2$, 60 pounds of ground tobacco (particle size <150 microns) and 5 pounds $(NH_4)_2CO_3$ was then added forming a thick "dough."

This was then extruded through a single hole die into $CaCl_3$—HCl to form a cigarette rod. The extrudate was thus set into a solid, partially foamed, cylindrical rod. The extrudate was then rinsed with water and dried/-foamed at 125° C. The foamed cylindrical rod was cut to cigarette size and it was found to be easy to draw and produce a mild smoking product.

EXAMPLE 17

Ten pounds of guar gum was dissolved in 40 gallons of 120° F. water. To this, 20 pounds of ground $CaCo_3$ (particle size <250 microns) was added and mixed therein. The addition of 1 pound of concentrated $NH_4OH$ and 10 pounds of Na alginate whose structure was rich in D-mannuronic units followed and a slurry was thus formed for extrusion or casting. The extruded/cast material was processed into a cigarette filler.

NOTE: The guar gum, which is a nonionic gum, was used to coat the $CaCO_3$ and thus reduce the $CA^{++}$ availability to the alginate and subsequently prevent the premature gelation of the slurry.

The thus made material was used in blended cigarettes with tobacco or was cased with tobacco extracts and then made into cigarettes which were found to be subjectively acceptable and tobacco-like in taste and aroma. The nicotine and tobacco tars were also reduced in the smoke.

EXAMPLE 18

Ten pounds of alpha-cellulose slightly beaten and loosened to have a standard Canadian freeness of 300–800 mls was pulped in 25 gallons of water. To this 2 pounds of Mg acetate were added. The above materials were mixed for five minutes and then the following ingredients were added:

2.0 pounds of $K_3$-citrate
1.5 pounds of bentonite clay
2.0 pounds of urea
2.0 pounds of caramel color
10.0 pounds of guar gum The above slurry was refined with a Sprout Waldron refiner and 25 gallons of additional water and 55 pounds of ground $CaCO_3$ (particle size <250 microns) were added and mixed therein.

To the above slurry, 16.5 pounds of Na alginate whose structure was rich in D-mannuronic acid units were added and mixed. This slurry was then extruded/-cast and dipped in a 25% $CaCl_3$, 0.2% HCl—$H_2O$ bath. The produced filler was made into cigarettes and smoked. All the cigarettes were found to be mild and acceptable.

SMOKING DATA

| | 100% Tobacco | 20% Filler Ex. 18 80% Tobacco | 40% Filler Ex. 18 60% Tobacco | 60% Filler Ex. 18 40% Tobacco | 100% Filler Ex. 18 |
|---|---|---|---|---|---|
| TPM mg/cig | 26.2 | 19.8 | 14.7 | 9.6 | 3.4 |
| Nicotine mg/cig | 1.63 | 1.22 | 0.084 | 0.49 | 0.0 |
| FTC Tar mg/cig | 21.3 | 16.1 | 12.3 | 8.2 | 3.2 |
| Puff Count # puffs/cig | 10.5 | 9.3 | 8.3 | 7.6 | 6.6 |
| Tar mg/puff | 9.0 | 1.7 | 1.5 | 1.1 | 0.49 |
| CO mg/puff | 1.7 | 1.7 | 1.4 | 1.3 | 1.0 |
| Acetaldehyde mg/puff | 0.10 | 0.07 | 0.05 | 0.05 | 0.03 |
| HCN | 0.026 | 0.017 | 0.012 | 0.010 | 0.004 |

-continued

| | SMOKING DATA | | | | |
|---|---|---|---|---|---|
| | 100% Tobacco | 20% Filler Ex. 18 80% Tobacco | 40% Filler Ex. 18 60% Tobacco | 60% Filler Ex. 18 40% Tobacco | 100% Filler Ex. 18 |
| mg/puff | | | | | |
| NO mg/puff | 0.024 | 0.022 | 0.020 | 0.013 | 0.004 |

EXAMPLE 19

In preparation for a dry extrusion process, the following formulation was combined to form a slurry:

40 parts cellulose acetate
200 parts acetone
10 parts sucrose
8 parts glycerin
40 parts $CaCO_3$
2 parts $K_3$-citrate The slurry was extruded through a die into desirable shapes. It was then dried, treated with a base, such as $NH_4OH$, to regenerate the cellulose, and then dried again.

EXAMPLE 20

In preparation for a melt extrusion process, the following formulation was combined to form a dry mixture:

40 parts ethyl cellulose and/or hydroxypropyl cellulose and/or other similar gums
40 parts Mg-citrate
10 parts sucrose
10 parts glycerin The mixture was extruded into the desired shape through the use of a screw-type melt extruder normally used for the extrusion of plastics. Foamed extrudates were also made with this approach by incorporating a blowing agent such as $(NH_4)_2CO_3$ into the mixture or by injecting a solution or solvent into the melt extruder.

EXAMPLE 21

A slurry of nontobacco material was formulated in the following manner:

Water (600 parts), citric acid (9.65 parts), malic acid (6.70 parts), and acetic acid (2.0 parts) were mixed and added to chitosan (16.1 parts).

The chitosan used was "Kytex," the trademark for cationic marine polymers manufactured by Hercules, Inc. "Kytex" is a partially deacetylated chitin formed by the reaction of chitin with concentrated alkali.

The chemical structure below is that of a molecule of "Kytex."

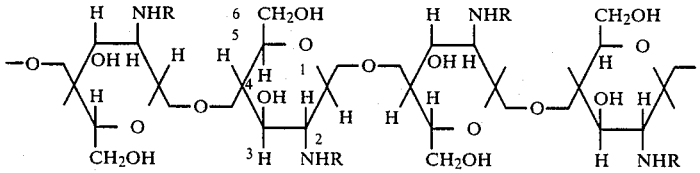

In this structure, R is $CH_3CO$ for chitin. As deacetylation progresses, "Kytex" is formed and some R becomes H. Chitin may be considered a modified cellulose in which the hydroxyl substituent on the number 2 carbon atom has been replaced with an acetylamino group. Like cellulose, chitin is insoluble in all except a few exotic or unusual solvents. In contrast, "Kytex" is soluble in many dilute acids below a pH level of 5.5. With 80 to 85% of the original acetylamino groups converted to primary amino groups, "Kytex" behaves as a cationic polymer in solution by protonation.

The ingredients listed above were agitated until all of the chitosan was in solution. To that mixture, glycerin (8.0 parts), alpha-cellulose (10.0 parts), $Mg(OH)_2$ (2.0 parts), $KHSO_4$ (1.7 parts), K-sorbate (0.3 parts), bentonite (1.5 parts), caramel color (3.0 parts), "Methocel'-'—the trademark of Dow Chemical Company for methylated cellulose—(4.0 parts), and coarse $CaCO_3$—particle diameter ranging from 2–300 microns, with 45% of the salt larger than 10 microns in diameter and preferably over 30 microns—(50.0 parts) were added. A slurry was formed by thoroughly mixing all the materials.

Air was metered into the slurry at the point of casting by using an inline static mixer or an Oakes mixer. The continuous foaming machine was connected to a delivery pipe line which was equipped with a device which restricted the flow pressure, the foam formed in the foaming head was very mobile. Full expansion was realized only as the foam issued from the delivery pipe and/or as the treated slurry was cast and dried into the desired shape. The drying was done with hot air (but could be done with steam or by using infrared or microwaves). After the cast sheet had been dried and conditioned, it was removed from the stainless steel belt with a "doctor" knife.

When the sheet was submitted for testing, the following results were found:

| Sheet Weight $g/ft^2$ | Thickness mls | Dry Tensile Kg/in | Wet Tensile Kg/in |
|---|---|---|---|
| 10.8 | 7.4 | 1.78 | 0.4 |

The wet material, when folded and pressed together, did not stick to itself. Subjective evaluation of the smoke of cigarettes made from the formulation showed that the smoke qualities were acceptable.

EXAMPLE 22

A slurry of nontobacco material was formulated as in Example 21 from the following materials:

Water—600 parts
Citric acid—9.65 parts
Malic acid—6.70 parts
Acetic acid—2.0 parts These were mixed well and added to 20.0 parts of chitosan, which was then mixed until all the chitosan was dissolved. Additional materials added to the slurry were:

Glycerin—8.0 parts
Alpha-cellulose—10.0 parts
$K_3$-citrate—2.0 parts
"Methocel"—4.0 parts
Caramel color—3.0 parts $CaCO_3$ (coarse)—56.0 parts As in Example 21, air was added to the slurry prior to casting. The slurry was cast, foamed with air introduced by means of an in-line static mixer, and dried with hot air. Results:

| Sheet Weight g/ft$^2$ | Thickness mls | Dry Tensile Kg/in | Wet Tensile Kg/in |
|---|---|---|---|
| 11.7 | 15.76 | 1.7 | 0.47 |

Subjective evaluation of the smoke from cigarettes made from the formulated filler termed it "not disagreeable."

EXAMPLE 23

Using the same procedures given in the Examples 21 and 22 above, the following formulation was cast into a sheet:

Water—600 parts
Formic acid—2.0 parts
Acetic acid—3.5 parts
Chitosan—16.0 parts
Glycerin—5.0 parts
Cellulose—10.0 parts
Mg $(OH)_2$—2.0 parts
$K_3$-citrate—2.0 parts
Caramel color—3.0 parts
$CaCO_3$ (coarse)—57 parts
Bentonite—1.5 parts
"Methocel"—4.0 parts Test results on sheet:

| Sheet Weight g/ft$^2$ | Thickness mls | Dry Tensile Kg/in | Folded Tensile Kg/in | Wet Tensile Kg/in |
|---|---|---|---|---|
| 14.4 | 11.0 | 1.1 | 0.75 | 0.3 |

This filler was used to make cigarettes and the smoke from them was analyzed for carbon monoxide, acetaldehyde, hydrogen cyanide by infrared analysis, and CO, NO, cyanides, and total aldehydes by gas chromatography. Results:

| | All Tobacco Control | All Synthetic Experimental Cig | % Reduction on a per Puff Basis |
|---|---|---|---|
| IR GAS-PHASE ANALYSIS* | | | |
| CO, mg/cig | 15.90 | 9.50 | 56 |
| Acetaldehyde, mg/cig | 0.78 | 0.36 | 66 |
| HCN, mg/cig | 0.18 | 0.08 | 67 |
| Number of puffs/cig | 7.00 | 9.50 | |
| GAS CHROMATOGRAPHY PUFF-BY-PUFF GAS-PHASE | | | |
| CO, mg/cig | 15.00 | 9.00 | 51 |
| Total aldehydes, | 1.11 | 0.56 | 59 |
| Total cyanides, | 0.18 | 0.09 | 59 |
| Total NO | 0.40 | 0.19 | 61 |
| Number of puffs/cig. | 9.00 | 11.00 | |

*The IR method for the analysis of gas phase of cigarette smoke is used to determine the absolute deliveries of certain gas phase components. The reduction is determined from the decrease of the infrared absorbance band intensities as the smoke of the test cigarette is compared with the infrared absorbance band intensities of the smoke from the control cigarette.

The experimental cigarettes produced smoking results with significant gas phase reductions in CO, aldehydes, HCN, and NO.

EXAMPLE 24

A slurry of nontobacco material, chitosan, was formulated in the following manner:

Chitosan (16 parts) was dissolved in water with 2.0 parts of formic acid and 3.5 parts of acetic acid. Into this the following ingredients were added: glycerin—5 parts; cellulose—10 parts; magnesium hydroxide—2 parts; potassium citrate—2 parts; calcium carbonate—57 parts; bentonite—1.5 parts; caramel color—3 parts; and "Methocel"—4 parts.

This formulation was mixed well and cast on a stainless steel belt. The cast slurry was dried and the formed sheet was taken from the belt by a doctor knife.

The sheet had an acceptable wet tensile strength because of the method of formulation by which the chitosan solution had been neutralized by the magnesium hydroxide and calcium carbonate. This neutralization process converted the chitosan solution to a water-insensitive form of the chitosan. Results:

| Dry Tensile Kg/in | Wet Tensile Kg/in | Folded Tensile Kg/in |
|---|---|---|
| 1.1 | 0.30 | 0.75 |

Variations and modifications may, of course, be made without departing from the spirit and scope of the present invention.

I claim:

1. A process for fixing a water-soluble salt in a cellulosic material comprising:

(a) providing an aqueous slurry of the cellulosic material and a water-soluble salt effective to impregnate said cellulosic material; and (b) adding to said slurry an ammonium or alkali metal salt capable of precipitating a cation of said water-soluble salt, thereby fixing said cation in the cellulosic material.

2. A process for incorporating a water-soluble salt in a matrix of cellulosic material such that good penetration of the salt within the matrix is achieved comprising:

(a) forming an aqueous slurry of the cellulosic material;

(b) adding to said slurry an ammonium or alkali metal salt capable of precipitating the cation of a selected water-soluble salt, and thereafter (c) adding the selected water-soluble salt to said slurry, whereby the cation of said water-soluble salt is fixed throughout the matrix of said cellulosic material.

3. The process of claim 2 wherein said water-soluble salt includes a metal salt of an organic or inorganic acid selected from the group consisting of calcium salts, magnesium salts, iron salts, aluminum salts, and mixtures thereof.

4. The process of claim 1 wherein the said water-soluble salt includes a metal salt of an organic or inorganic acid selected from the group consisting of calcium salts, magnesium salts, iron salts, aluminum salts, and mixtures thereof.

5. The process of claims 4 or 3 wherein the metal salt is a calcium salt.

6. The process of claims 4 or 3 wherein the organic acid is selected from the group consisting of formic acid, acetic acid, propionic acid, butyric acid, valeric acid, methylvaleric acid, isovaleric acid, hexanoic acid, heptanoic acid, octanoic acid, benzoic acid, phenylacetic acid, citric acid, malic acid, tartaric acid, gluconic acid and malonic acid and its lower alkyl derivatives, and combinations thereof.

7. The process of claims 4 or 3 wherein the inorganic acid is selected from the group consisting of hydrochloric acid, sulfuric acid, phosphoric acid, carbonic acid, and combinations thereof.

8. The process of claims 1 or 2 wherein the cellulosic material is selected from the group consisting of alpha-cellulose, substituted cellulosic materials, and combinations thereof.

9. The process of claim 8 wherein the substituted cellulosic material is selected from the group consisting of carboxymethyl cellulose and its salts, crosslinked CMC and its salts, methyl cellulose, hydroxypropyl methyl cellulose, hydroxypropyl cellulose, ethyl cellulose, ethyl hydroxyethyl cellulose, hydroxyethyl cellulose, and combinations thereof.

10. The product produced by the process of claim 4.

11. The process of claims 1 or 2 which further includes the addition of from about 3 to 40% by weight of an additive selected from the group consisting of pectins and their Na, K, $NH_4$, Ca or Mg salts, alginic acid and its Na, K, $NH_4$, Ca or Mg salts, and combinations thereof.

12. The process of claims 1 or 2 which further includes the addition of from about 3 to 40% by weight of a gum selected from the group consisting of guar gum, modified guar gum, xanthan gum, locust bean gum, starch, curdlan, gum arabic, salts of xanthanomonas gum, and combinations thereof.

13. The process of claims 1 or 2 which further includes the addition of from about 1 to 15% by weight of a sugar or humectant selected from the group consisting of sucrose, reducing sugars, glucosamine, honey, corn syrup, glycerine, triethylene glycol, diglycerol, diglycerol tetraacetate, esters of sugars with $C_2$–$C_8$ carbon atom carboxylic acids, and combinations thereof.

14. The process of claims 1 or 2 which further includes the addition of from about 5 to 80% by weight of a chitin-type material selected from the group consisting of chitin, oxidized chitin, chitosan and its salts, chitin hydrolyzates, chitosan hydrolyzates, glucosamine, ground-deproteinated shells of crustaceans, and combinations thereof.

15. The process of claim 14 in which the chitin-type material has been pyrolyzed to form a pyrolysate.

16. The process of claims 1 or 2 which further includes the addition of a heat-treated carbohydrate material selected from the group consisting of cellulose, starch, modified cellulosics, modified starches, gums, wood, plant parts, coffee hulls, peanut hulls, and combinations thereof.

17. The process of claim 16 wherein up to 80% by weight in the final product of heat-treated carbohydrate material is added.

18. The process of claim 17 wherein the heat-treated carbohydrate material has been pyrolyzed to a weight loss of from 10 to 90%.

19. The process of claims 1 or 3 which further includes the addition of from about 10 to 75% by weight of calcium carbonate having an average equivalent spherical diameter in the range of from about 10 to 300 microns, with no more than about 20% by weight of the calcium carbonate having an equivalent spherical diameter less than 2 microns.

20. The process of claims 4 or 9 wherein the metal salt is added in an amount of from 5 to 40% by weight, based on the cellulosic material.

21. The process of claim 4 wherein the ammonium or alkali metal salt capable of precipitating the cation of said water-soluble salt is selected from the group consisting of ammonium phosphate, sodium phosphate, potassium phosphate, ammonium metaphosphate, sodium metaphosphate, potassium metaphosphate, the ammonium, sodium, or potassium salts of pyrophosphoric acid, ammonium silicate, sodium silicate, potassium silicate, ammonium oxalate, sodium oxalate, potassium oxalate, ammonium malate, sodium malate, potassium malate, ammonium citrate, sodium citrate, potassium citrate, ammonium tartrate, sodium tartrate, potassium tartrate, ammonium carbonate, sodium carbonate, potassium carbonate, ammonium bicarbonate, sodium bicarbonate, potassium bicarbonate, and combinations thereof.

22. The product produced by the process of claim 1.

23. The process of claim 3 wherein the ammonium or alkali metal salt capable of precipitating the cation of said water-soluble salt is selected from the group consisting of ammonium phosphate, sodium phosphate, potassium phosphate, ammonium metaphosphate, potassium metaphosphate, the ammonium, sodium, or potassium salts of pyrophosphoric acid, ammonium silicate, sodium silicate, potassium silicate, ammonium oxalate, sodium oxalate, potassium oxalate, ammonium malate, sodium malate, potassium malate, ammonium citrate, sodium citrate, potassium citrate, ammonium tartrate, sodium tartrate, potassium tartrate, ammonium carbonate, sodium carbonate, potassium carbonate, ammonium bicarbonate, sodium bicarbonate, potassium bicarbonate, and combinations thereof.

24. The product produced by the process of claim 3.

25. The product produced by the process of claim 2.

* * * * *